US007617930B2

(12) United States Patent
Jones et al.

(10) Patent No.: US 7,617,930 B2
(45) Date of Patent: Nov. 17, 2009

(54) CIGARETTE PACKAGE

(75) Inventors: Wesley Steven Jones, Winston-Salem, NC (US); Pankaj Patel, Clemmons, NC (US)

(73) Assignee: R. J. ReynoldsTobacco Company, Winston-Salem, NC (US)

( * ) Notice: Subject to any disclaimer, the term of this patent is extended or adjusted under 35 U.S.C. 154(b) by 252 days.

(21) Appl. No.: 11/584,436

(22) Filed: Oct. 20, 2006

(65) Prior Publication Data

US 2008/0093234 A1 Apr. 24, 2008

(51) Int. Cl.
*B65D 85/10* (2006.01)
*B65D 85/12* (2006.01)

(52) U.S. Cl. ..... 206/256; 206/263

(58) Field of Classification Search ..... 206/190, 206/180, 499, 263, 261, 256, 257, 271, 248, 206/242, 273; 209/125, 44, 120.1
See application file for complete search history.

(56) References Cited

U.S. PATENT DOCUMENTS

| | | | | |
|---|---|---|---|---|
| 203,164 | A | 4/1878 | Kinney | |
| 3,007,623 | A | 11/1961 | Clemens | |
| 3,039,671 | A * | 6/1962 | Chiamardas | 206/256 |
| 3,127,083 | A | 3/1964 | Guyer | |
| 3,148,768 | A | 9/1964 | Gatto | |
| 3,226,010 | A | 12/1965 | Rogers, Jr. | |
| 3,695,422 | A | 10/1972 | Tripodi | |
| 3,874,581 | A | 4/1975 | Fox et al. | |
| 3,944,066 | A | 3/1976 | Niepmann | |
| 4,050,622 | A | 9/1977 | Shimada et al. | |
| 4,081,126 | A * | 3/1978 | Barnard | 206/256 |
| 4,294,353 | A | 10/1981 | Focke et al. | |
| D279,507 | S | 7/1985 | Schechter et al. | |
| 4,717,017 | A | 1/1988 | Sprinkel, Jr. et al. | |
| 4,753,383 | A | 6/1988 | Focke et al. | |
| 4,784,261 | A | 11/1988 | Kutchin | |
| 4,836,378 | A | 6/1989 | Lephardt | |
| 4,852,734 | A | 8/1989 | Allen et al. | |
| 4,923,059 | A | 5/1990 | Evers et al. | |
| 5,097,948 | A | 3/1992 | Campbell | |
| 5,139,140 | A | 8/1992 | Burrows et al. | |
| 5,143,282 | A | 9/1992 | Pham | |
| 5,192,262 | A | 3/1993 | Amendola et al. | |
| 5,214,901 | A | 6/1993 | Milliner | |
| 5,277,304 | A * | 1/1994 | Brizzi et al. | 206/256 |
| 5,333,729 | A | 8/1994 | Wolfe | |
| 5,392,905 | A | 2/1995 | Focke et al. | |
| 5,595,803 | A | 1/1997 | May et al. | |

(Continued)

FOREIGN PATENT DOCUMENTS

WO WO 04000690 A2 * 12/2003

*Primary Examiner*—Stephen Garbe
*Assistant Examiner*—Kaushikkumar Desai
(74) *Attorney, Agent, or Firm*—Brinks Hofer Gilson & Lione

(57) ABSTRACT

An assembled container for smoking articles includes an outer sleeve that includes a front wall, a rear wall, a right side wall, and a left side wall. Packets of cigarettes are positioned within the outer sleeve. For example, two packets, each containing ten cigarettes, are positioned within the outer sleeve. The packets, and the outer sleeve, include mechanisms that interact during movement of the individual packets within the outer sleeve. As such, a portion of each packet is maintained within the outer sleeve during conditions of normal use.

24 Claims, 19 Drawing Sheets

U.S. PATENT DOCUMENTS

| | | | | |
|---|---|---|---|---|
| 5,682,986 | A | 11/1997 | Cobler | |
| 5,911,359 | A * | 6/1999 | Stone et al. | 206/273 |
| 5,938,018 | A | 8/1999 | Keaveney et al. | |
| 6,363,691 | B1 | 4/2002 | Flaherty | |
| 6,612,429 | B2 | 9/2003 | Dennen | |
| 6,837,369 | B2 * | 1/2005 | Amos | 206/273 |
| 6,874,623 | B2 | 4/2005 | Bray | |
| 6,889,827 | B2 | 5/2005 | Stringfield | |
| 6,932,219 | B2 | 8/2005 | Chacko et al. | |
| D509,623 | S | 9/2005 | Mitten et al. | |
| D523,171 | S | 6/2006 | Mitten et al. | |
| D523,990 | S | 6/2006 | Mitten et al. | |
| 7,100,763 | B2 | 9/2006 | Draghetti | |
| 7,100,764 | B2 | 9/2006 | Focke | |
| D542,466 | S | 5/2007 | Polloni et al. | |
| 7,213,704 | B2 | 5/2007 | Li Vigni et al. | |
| 2005/0023158 | A1 | 2/2005 | Mitten et al. | |
| 2005/0150786 | A1 * | 7/2005 | Mitten et al. | 206/271 |
| 2005/0155878 | A1 | 7/2005 | Pham | |
| 2005/0241966 | A1 * | 11/2005 | Giannini et al. | 206/242 |
| 2006/0091026 | A1 | 5/2006 | Mitten et al. | |

* cited by examiner

CIGARETTE PACKAGE

FIELD OF THE INVENTION

The present invention relates to tobacco products, such as smoking articles, and in particular, to packages suitable for containing tobacco products.

BACKGROUND OF THE INVENTION

Popular smoking articles, such as cigarettes, conventionally have been sold in packages. Typically, each full package contains about 20 cigarettes. Cigarettes have been packaged in containers known as so-called "soft packs." See, for example, U.S. Pat. No. 3,695,422 to Tripodi; U.S. Pat. No. 4,717,017 to Sprinkel, Jr., et al.; and U.S. Pat. No. 5,333,729 to Wolfe, all of which are incorporated herein by reference. Cigarettes also have been packaged in containers known as so-called "hard packs" or "crush proof boxes." See, for example, U.S. Pat. No. 3,874,581 to Fox et al.; U.S. Pat. No. 3,944,066 to Niepmann; and U.S. Pat. No. 4,852,734 to Allen et al., all of which are incorporated herein by reference.

In certain circumstances, two or more packages, each package containing 20 cigarettes, are contained in paperboard sleeves, particularly for promotional purposes (e.g., for "Buy One-Get One Free," "By Two-Get One Free," or "Buy Two-Get a Lighter," types of marketing promotions). See, for example, U.S. Pat. No. 6,932,219 to Chacko et al., which is incorporated herein by reference. Various proposed types of cigarette package designs and configurations also are set forth in U.S. Pat. No. 3,007,623 to Clemens; U.S. Pat. No. 3,148,768 to Gatto; U.S. Pat. No. 3,226,010 to Rogers, Jr.; U.S. Pat. No. 4,294,353 to Focke et al.; U.S. Pat. No. 4,784,261 to Kutchin; U.S. Pat. No. 5,139,140 to Burrows et al.; U.S. Pat. No. 5,214,901 to Milliner; U.S. Pat. No. 5,682,986 to Cobler; U.S. Pat. No. 5,938,018 to Keaveney; U.S. Pat. No. 6,612,429 to Dennen; U.S. Pat. No. 6,837,369 to Amos; U.S. Pat. No. 6,889,827 to Stringfield; U.S. Pat. No. 7,100,763 to Draghetti; U.S. Pat. No. 7,100,764 to Focke; D509,623 to Mitten; D523,171 to Mitten et al.; D523,990 to Mitten et al.; and U.S. Pat. App. Pub. Nos. 2005/0023158 to Mitten et al.; 2005/0150786 to Mitten et al.; 2005/0155878 to Pham; and 2006/0091026 to Mitten et al., each of which is incorporated herein by reference. See also, for example, the types of packaging configurations used for cigarettes sold in Japan under the tradename "Duo Virginia Slims."

It would be highly desirable to provide an aesthetically pleasing cigarette package having at least two compartments that contain cigarettes. It also would be desirable to provide a cigarette package having discrete compartments, allowing each to be moved therein and opened independently to expose the cigarettes contained therein. Such an arrangement may provide an aesthetically pleasing package and may present improved freshness maintenance for the cigarettes.

SUMMARY OF THE INVENTION

The present invention relates to assembled containers for smoking articles, such as cigarettes. A representative container assembly includes an outer sleeve. At least two packets, each containing smoking articles, are positioned within that outer sleeve. For example, two packets, each packet containing 10 filtered cigarettes, can be positioned within the outer sleeve. Each packet can be moveable within the outer sleeve, and can readily be opened independently from one another in order to expose the cigarettes contained therein. Most preferably, the outer sleeve and each packet are adapted and arranged such that the packets tend to remain in contact with the outer sleeve during conditions of normal or intended use. That is, the overall construction of the container assembly preferably provides resistance to separating the individual packets from the container assembly. Specifically, it is preferable that, although each individual packet can be independently maneuvered and operated, the packets each are adapted and arranged in order to prevent release of the packets from the outer sleeve by a retaining means on the packet configured to interact with a retaining means on the outer sleeve, each retaining means being embodied as a flap, tab, or similar protrusion. Thus, the ability to maintain the overall integrity of packet assembly during conditions of normal and intended use over the useful lifetime of the container assembly is maintained.

In one aspect, an assembled container for smoking articles incorporates an outer sleeve or outer body portion that includes a front wall, a rear wall, a right side wall, and a left side wall, with each wall being generally vertically extending. The outer sleeve includes at least two vertically extending packets or compartments (e.g., one on the left side and one on the right side), and each packet contains smoking articles. Each packet includes a front wall, a rear wall, a right side wall and a left side wall; with each wall being generally vertically extending. The inner region of at least one side wall of the outer body portion includes a tab or other suitable means that acts as a stop or catch mechanism; and that mechanism cooperates with a corresponding or complementary tab or other suitable means that acts as a stop or catch mechanism located on at least one side wall of each packet. As such, each packet can be independently moved within the outer sleeve (e.g., vertically up and down), and independently operated (e.g., opened and shut), but under conditions of normal or intended use, at least a portion of each packet is maintained in contact with, or contained within, the outer sleeve.

BRIEF DESCRIPTION OF THE DRAWINGS

FIG. 12 has intentionally been omitted;

BRIEF DESCRIPTION OF THE PREFERRED EMBODIMENTS

Figure 1:
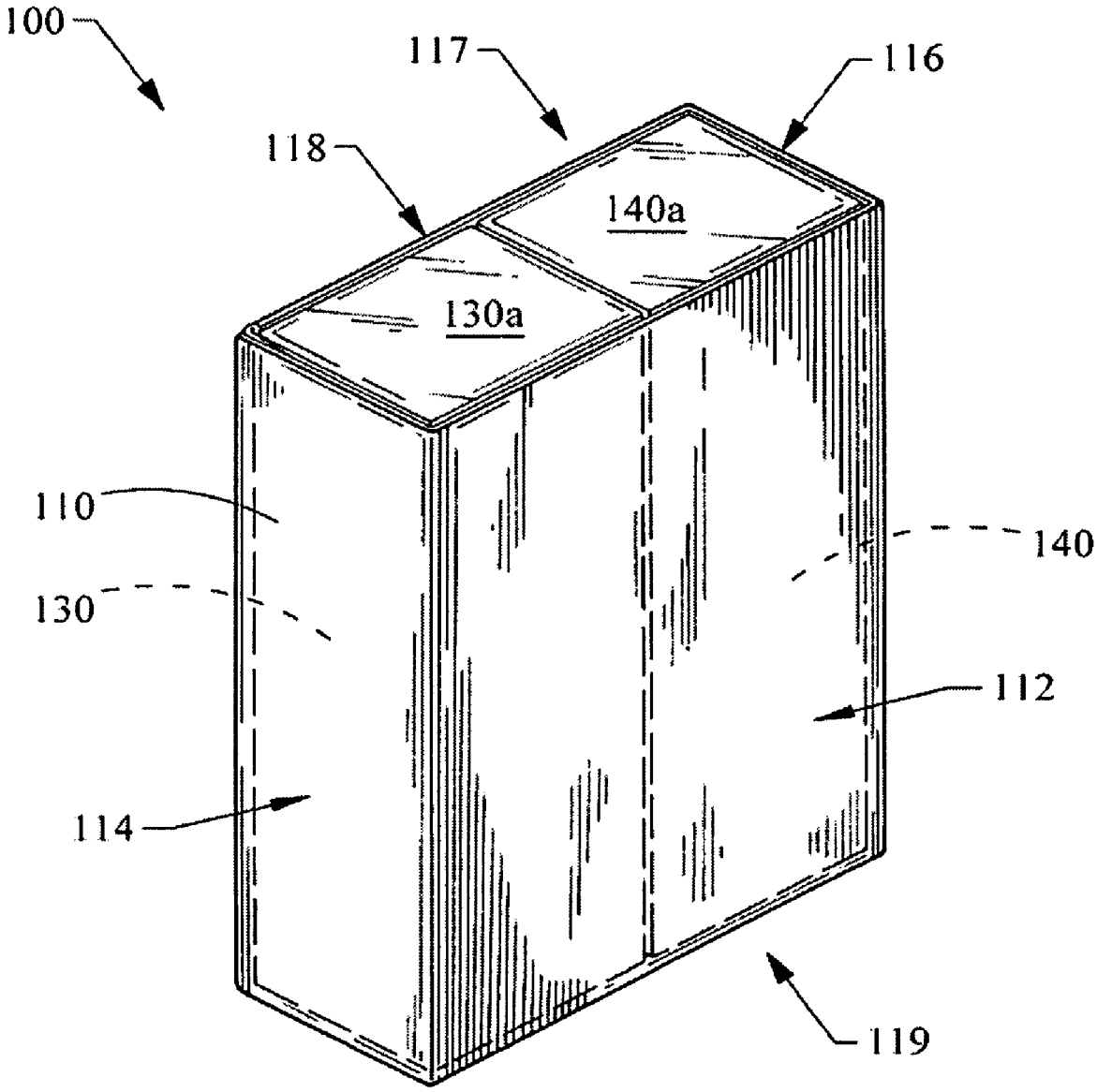
FIG. 1 is a front perspective view of one embodiment of an assembled container, including an outer sleeve that houses left and right packets, shown in a fully closed position.

Referring to FIG. 1, there is a front view of various components of an assembled container 100 that is representative of an embodiment of the present invention. That representative container assembly 100 includes an outer sleeve 110. A representative outer sleeve preferably is manufactured from a paperboard-type of material. The outer sleeve 110 includes a front wall 112. The outer sleeve 110 also has a left sleeve wall 114, a right sleeve wall 116, and a rear sleeve wall 118, each of which is generally vertical. When viewed from the top or from the bottom, the representative outer sleeve 110 has a generally rectangular shape (i.e., it is generally rectangular in cross-sectional shape). The outer sleeve 110 preferably is open at its top and bottom sleeve ends (117, 119, respectively).

Within the outer sleeve 110 is positioned a first packet 130 and a second packet 140. Other embodiments may have more packets. Preferably, each packet is substantially identical to the other packet(s) in overall shape, appearance, and size. For the embodiment shown, each packet is generally rectangular in cross-sectional shape. The outer body of each representative packet 130, 140 preferably is manufactured from a paperboard-type of material. Each packet 130, 140 includes a packet lid portion 130*a*, 140*a*, respectively (i.e., the packets are each shown in a closed position). For the embodiment shown, each packet 130, 140 is configured and positioned so that the right side wall of the first packet 130 and the left side wall 140*b* of the second packet 140 abut one another. Each packet is configured and positioned so that its vertical sides are generally circumscribed by the outer sleeve 110 when the container assembly 100 is fully closed. For the embodiment shown, the first and second packets each are configured so as to contain ten cigarettes (not shown). As such, an assembled container 100 containing twenty cigarettes can be provided. Preferably, the shapes and dimensions of the packets and outer sleeve are such that the packets, though movable within the outer sleeve, fit snugly within the outer sleeve, and as such, can generally be retained within the outer sleeve by friction fit. The assembled container 100 preferably is wrapped in an overwrap material, such as polypropylene film (e.g., of the type typically used for wrapping cigarette containers; not shown). Each of the packets 130, 140 may also be individually overwrapped, although, for the embodiment shown, each packet is not individually overwrapped.

Figure 2:
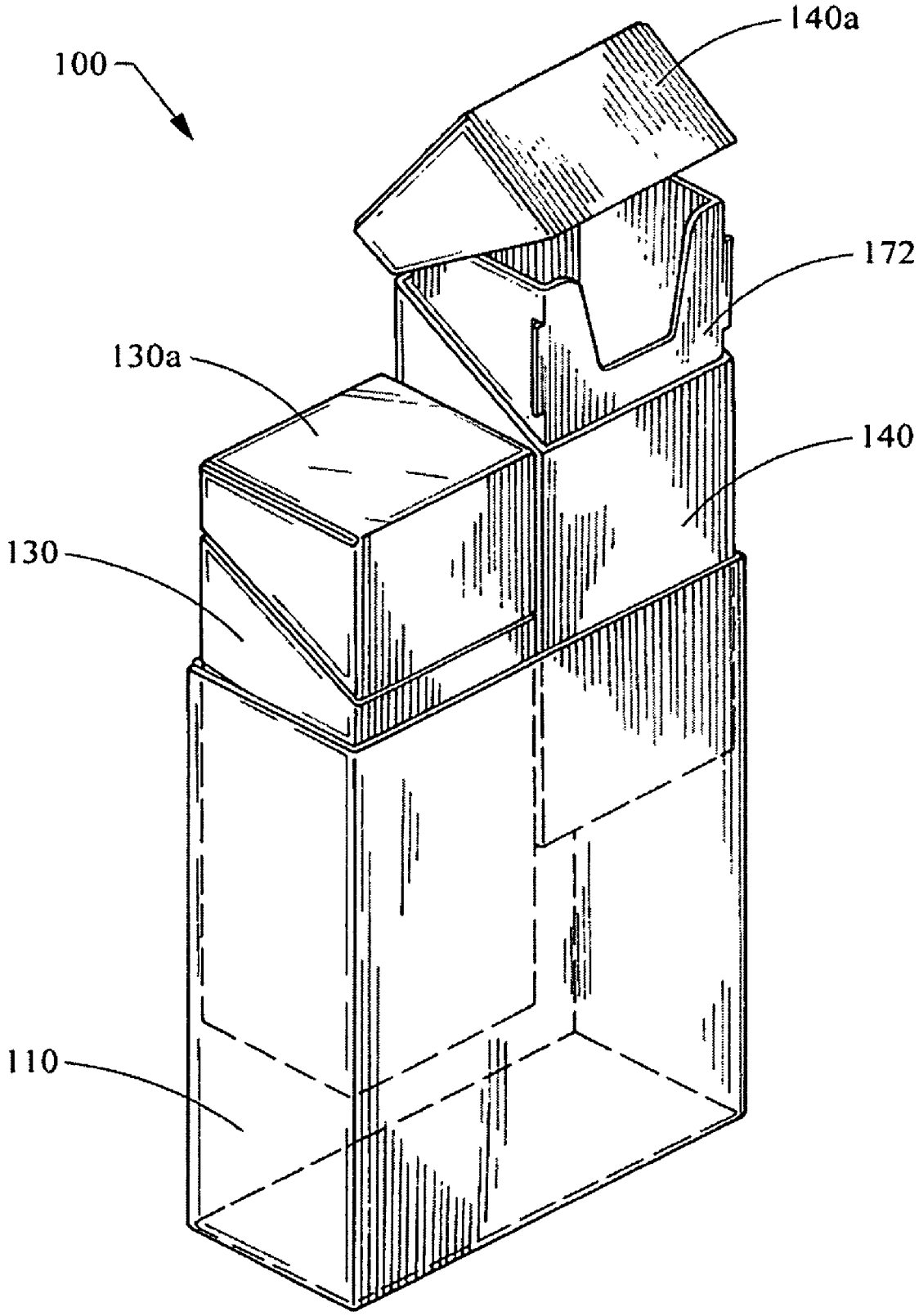
FIG. 2 is a front perspective view of the assembled container of FIG. 1, and is shown with each of two packets in the outer sleeve having been moved upward, with the left packet shown in a closed position and the right packet shown in an open position as well as being moved further upward than the left packet.

Referring to FIG. 2, the container assembly 100 is shown as having been placed in a partially open position. That is, the first packet 130 has been moved upwardly within the outer sleeve 110, and second packet 140 also has been moved upwardly within the outer sleeve 110. The first packet 130 is shown as having been slid upwards within the outer sleeve to less than maximum upward movement and is shown in a closed position. For the embodiment shown, the second packet 140 is shown as having been moved to its maximum normal upward movement and is shown in an open position, such that an upper frame insert structure 172 is visible. The upper frame insert structure 172 provides for ease of access to the packet's contents while aiding structural integrity in the lid region. As shown, each packet 130, 140 can be moved upwards and downwards independently within the outer sleeve 110, and the packet lid portion 130*a*, 140*a* of each packet 130, 140 can be opened independently. However, under conditions of normal or intended use, it is most preferable that at least a portion of each packet 130, 140 maintains contact with, or is contained within, the outer sleeve 110.

Figure 3:
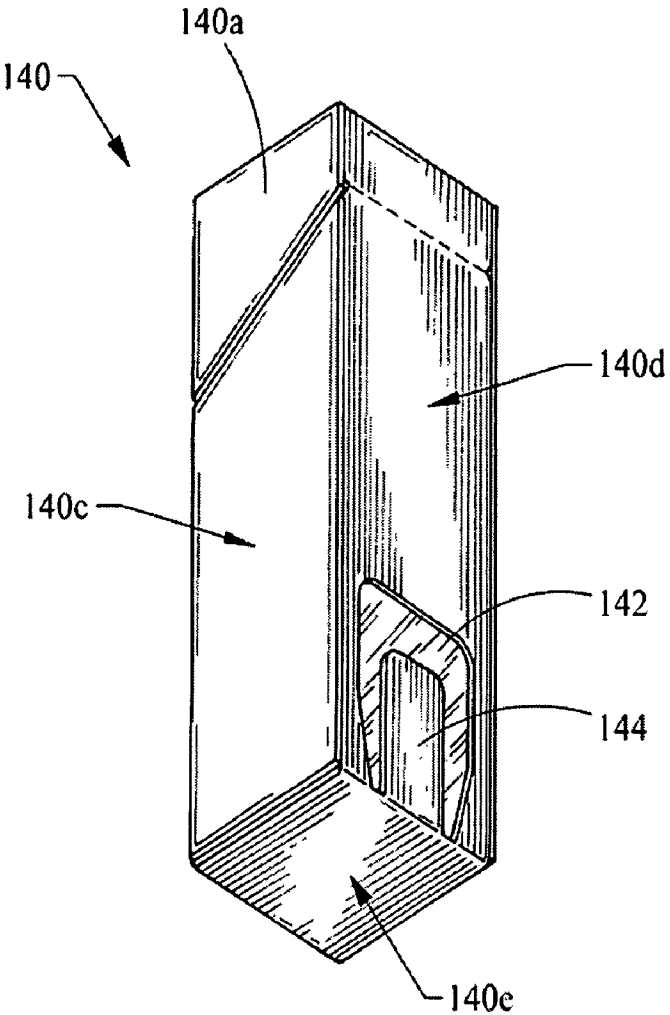
FIG. 3 is a rear perspective view of a packet embodiment that has been removed from the outer sleeve.

Referring to FIG. 3, there is shown a rear view of the second packet 140 of the type described previously with reference to FIGS. 1 and 2. The packet 140 includes a right packet wall 140*c* and a rear packet wall 140*d*. Near the bottom of the rear packet wall 140*d*, is an open packet cut-out region 142, which defines the margins of a generally upwardly extending catch-tab 144. For the embodiment shown, the catch-tab 144 is integrally connected along a fold to the bottom packet wall 140*e* and is biased outwardly to extend at least slightly from a plan defined by the rear packet wall 140*d*. Other types of representative packets that can be suitably adapted or modified in such a manner are of the type set forth in U.S. Pat. No. 3,007,623 to Clemens and U.S. Pat. No. 3,226,010 to Rogers, Jr.; and U.S. Pat. App. Pub. Nos. 2005/0023158 to Mitten et al. and 2005/0150786 to Mitten et al., each of which is incorporated herein by reference. If desired, suitable tabs or catch mechanisms can be provided by other means, such as a separate tab piece that is adhered to an appropriate location on the packet, and—alternatively—adhered to the outer sleeve.

Figure 4:
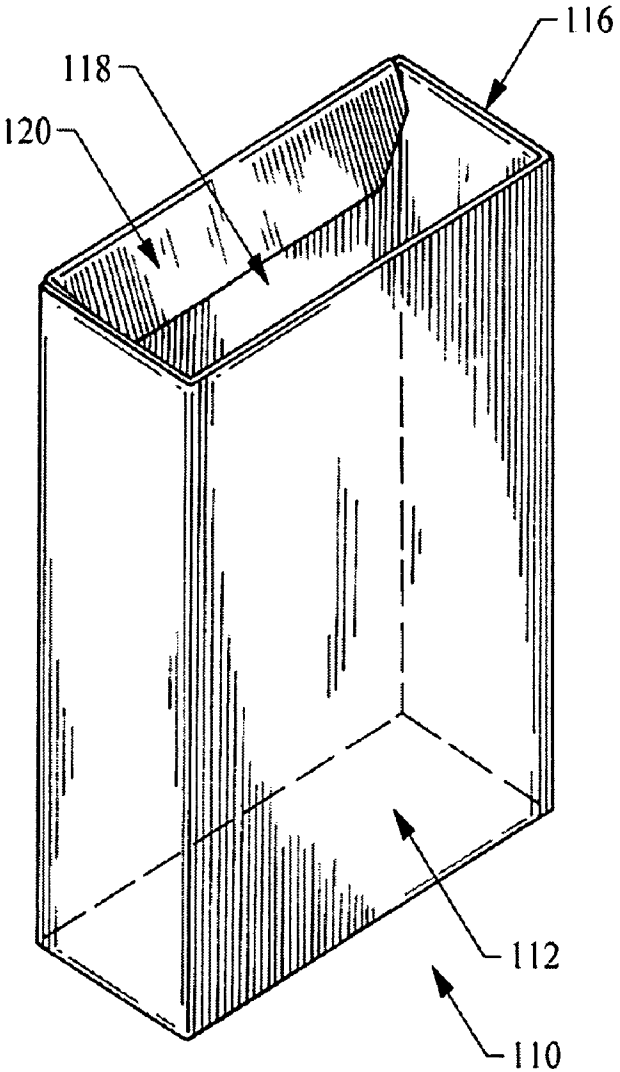
FIG. 4 is a front perspective view of the outer sleeve having had the packets removed therefrom.

FIG. 4 depicts the outer sleeve 110 of the container assembly 100. The outer sleeve 110 includes a front sleeve wall 112 and a right sleeve wall 116, as well as a generally downwardly extending and slightly forwardly biased retention flap 120. The retention flap 120 is continuous with the rear sleeve wall 118 of the outer sleeve 110 and is biased inwardly to form a slight protrusion. Those of skill in the art will appreciate that—as a packet (e.g., packet 130) is moved upward, a protrusion on the packet (e.g., catch-tab 144) will engage the retention flap 120 to prevent the packet from being moved past it. In alternative embodiments, the retention flap may be located on one or more of a front or side sleeve wall, with packet protrusion(s) mounted in a corresponding location(s) on the packet. Also, in other embodiments (not shown), the outer sleeve may include a lower/bottom wall at the end opposite the retention flap.

In a preferred use, each packet is assembled and filled with an appropriate number of smoking articles such as cigarettes or cigarillos. For example, each packet can be filled with ten cigarettes; those cigarettes are most preferably aligned so that the longitudinal axes of those cigarettes are generally parallel to the longitudinal axis of the packet that contains those cigarettes. Either the lighting end or filter ends, but most preferably the filter ends, of those cigarettes are positioned at the top of each packet. The inner top region of each packet can contain an inner wrapping material (e.g., embossed foil lined paper laminate, or other aesthetically pleasing type of inner liner wrapping material of the type conventionally used within cigarette packages) that is fashioned, folded, or adapted so as to cover or contain the cigarettes within each packet. See, for example, U.S. Pat. Pub. No. 2006/0168909 to Miyaoka et al., which is incorporated herein by reference. The packets then are positioned within the outer sleeve. During use by the smoker, the overwrap material is opened and removed from the outer sleeve. Then, either or both of the packets can be urged upwards within the outer sleeve, typically by pushing upwards on the bottom wall of either or both packets with fingers or thumb through the bottom of the outer sleeve. However, the cooperating catch mechanisms of each of the respective packets within the outer sleeve act to limit a user's ability to readily fully remove each packet from the outer sleeve. The packets, and the outer sleeve, include components that interact during movement of the individual packets within the outer sleeve. As such, a portion of each packet is maintained within the outer sleeve during conditions of normal use. That is, the overall integrity of the movable assembly can be maintained under conditions of intended normal use. Each individual packet can be opened by the smoker to remove a cigarette as desired and subsequently closed. The packets then can be slid back down into the outer sleeve into a fully closed position for handling and storage.

Figure 5:
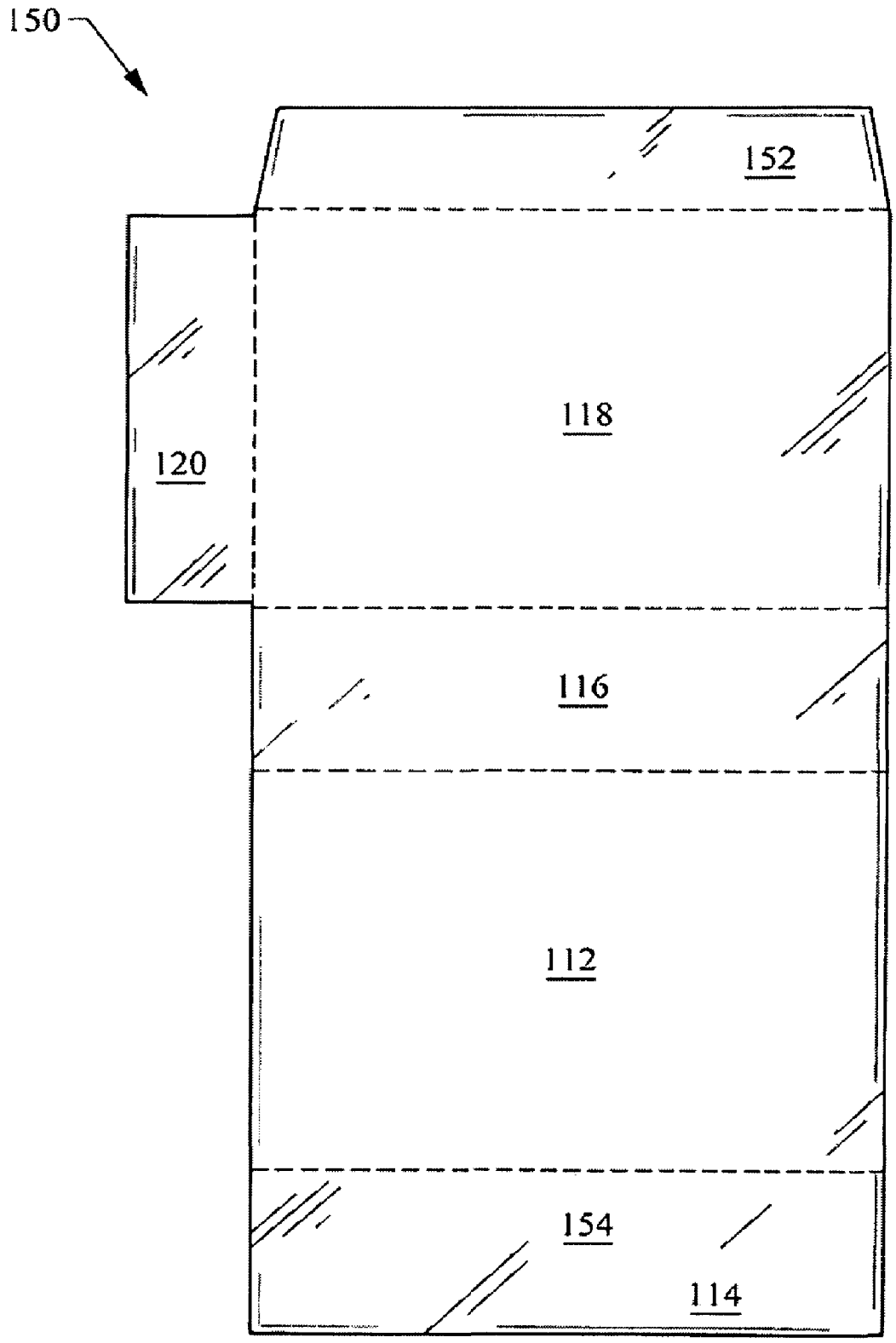
FIG. 5 is a diagrammatic illustration of a blank configured to form an outer sleeve embodiment.

Referring to FIG. 5, there is shown a first outer sleeve blank 150 that is configured to be formed to provide an outer sleeve 110. (For each of the blanks illustrated herein, those of skill in the art will appreciate how each is to be folded into an outer sleeve or packet as indicated by the outer margins and by fold lines, which are indicated in dashed lines in the figures.) The first outer sleeve blank 150 is designed to provide an underlying lap seam region 152 at one side that—during assembly—will be folded under an overlying lap seam region 154 that forms the left side wall 114 at its opposite side. The first outer sleeve blank 150 also includes a right side wall 116, a front wall 112, and a rear wall 118. The blank is configured to be fashioned into the outer sleeve 110 (e.g., by application of a suitable adhesive along the lap seam region and contact of the two lap seam regions, and by folding down the retention flap 120). The relevant region of the outer surface of the blank may be printed with brand logos, brand-related colors and graphics, UPC bar code graphics, excise tax related information, regulatory content, and the like, and the inner surface can also be printed as well (e.g., with promotional items or coupons). The blank also includes a retention flap 120 extending upward from the top portion of the rear wall. Downward folding, and inward facing, of the retention flap 120 can be facilitated by a creased line, a pre-stressed fold line, a score line, a line of perforations, or a line of cuts, in the region or along the line that delineates the rear sleeve wall 118 and the retention flap 120.

Figure 6A:
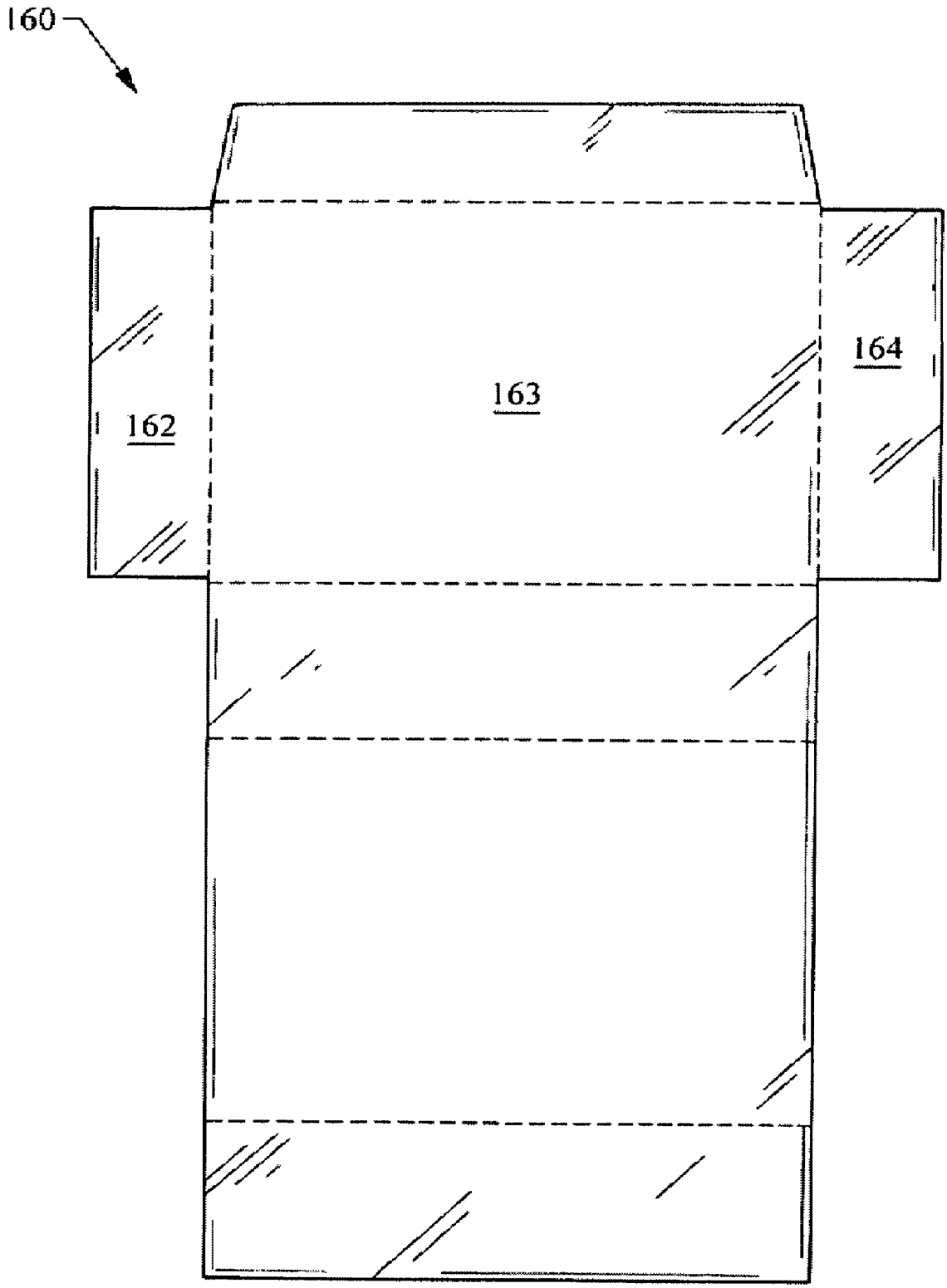
FIGS. 6A-6B are diagrammatic illustrations of a blank configured to form other outer sleeve embodiments.
Figure 6B:
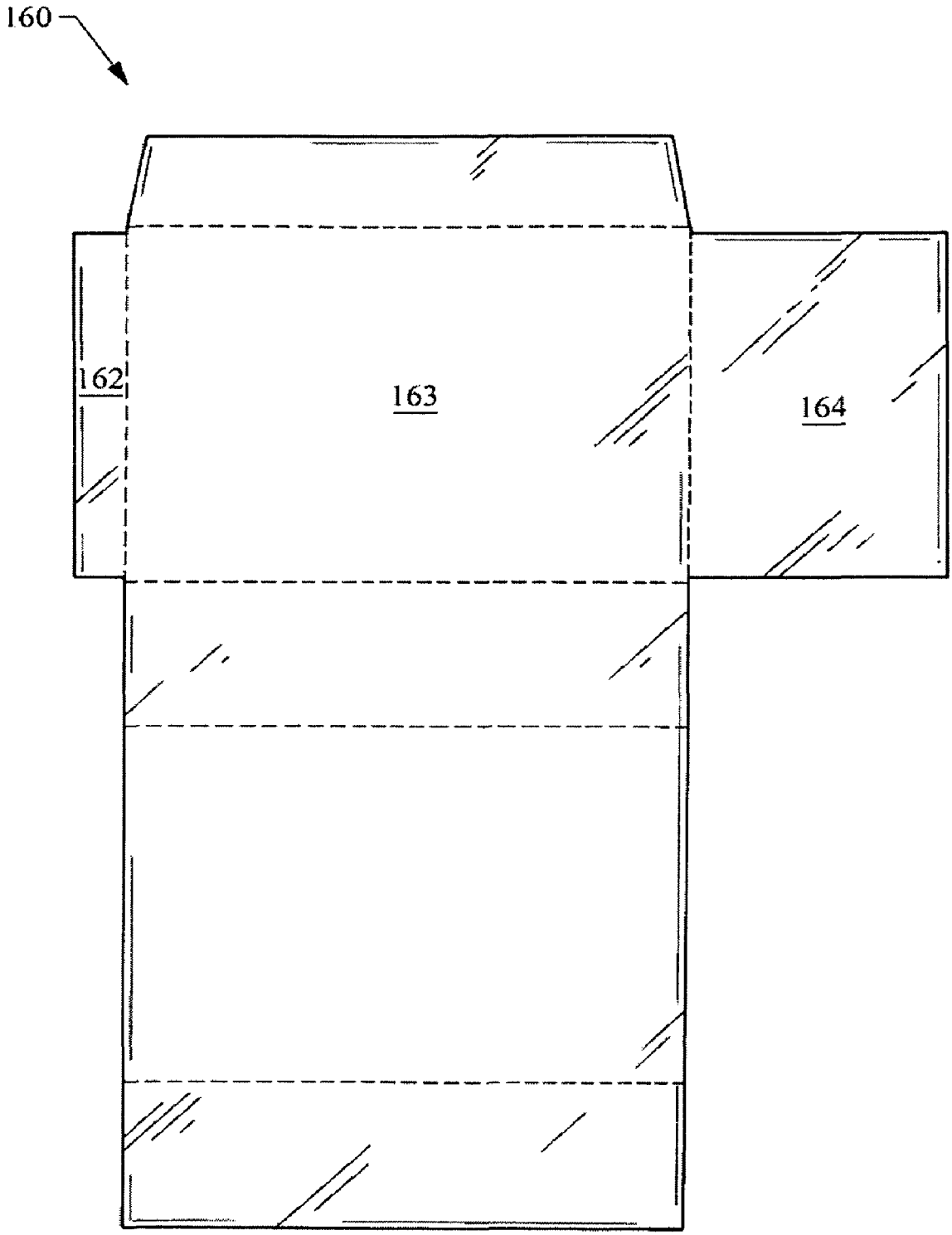

Referring to FIGS. 6A-6B, there is shown a second outer sleeve blank 160 that is configured to be formed into an outer sleeve and is generally similar in many regards to the blank described previously with reference to FIG. 5. The blank includes an upper retention flap 162 extending from the top portion of its rear wall 163. Downward folding and inward biasing of the retention flap 162 may be facilitated by a creased line, a pre-stressed fold line, a score line, a line of perforations, or a line of cuts along a line that separates the rear wall 163 from the flap 162. The second outer sleeve blank 160 also includes a lower retention flap 164 extending downward from the bottom portion of the rear wall 163. Upward folding and inward biasing of the retention flap 164 can also be facilitated by a creased line, a pre-stressed fold line, a score line, a line of perforations, or a line of cuts in the region or along the line that separates the rear wall 163 from the lower retention flap 164. As such, the second outer sleeve blank 160 can be formed into an outer sleeve that includes two catch/stop means: a first to provide resistance to removal of packets through the top of that outer sleeve, and a second to provide resistance to removal of packets through the bottom of that outer sleeve. The length of each retention flap (along the top-to-bottom axis) can be selected in order to provide control of a desired extent that the packets can move upward and downward within the outer sleeve. As shown in FIG. 6B, the lower retention flap 164 may be lengthened to limit downward motion by an amount greater than the shorter lower retention flap 164 shown in FIG. 6A.

Figure 7A:
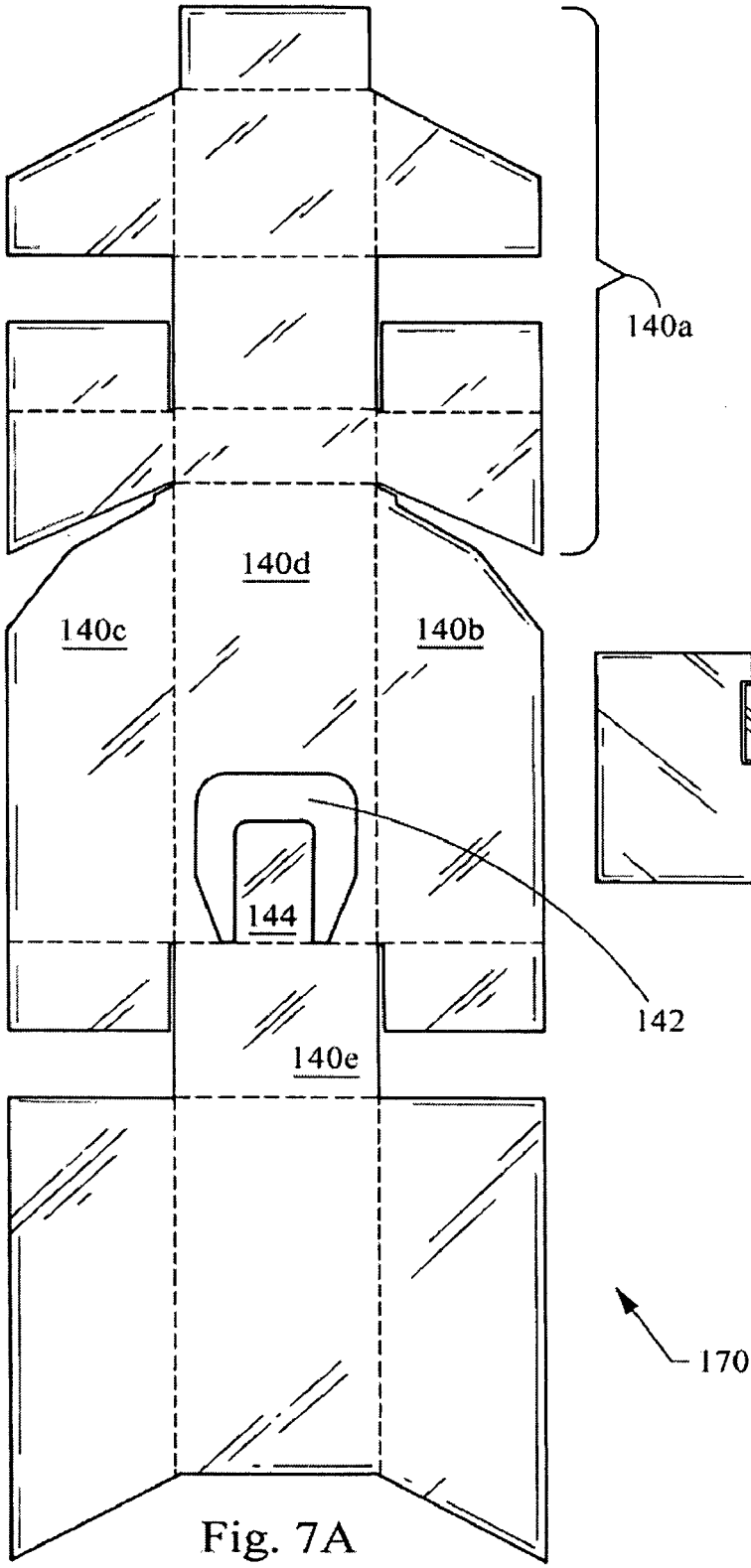
FIG. 7A is a diagrammatic illustration of a blank configured to form a packet embodiment.
Figure 7B:
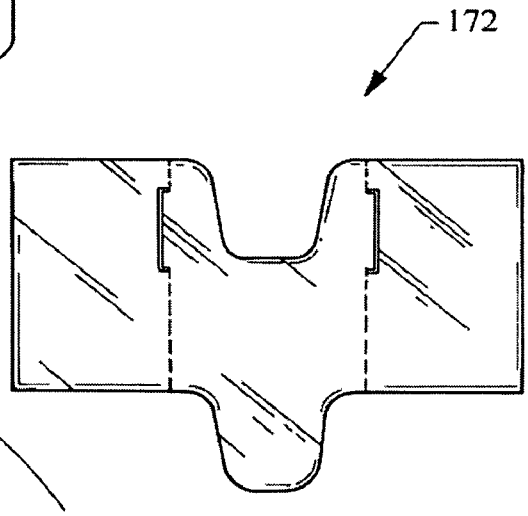
FIG. 7B is a diagrammatic illustration of a blank configured to form an insert portion of the packet embodiment of FIG. 7A.

Referring to FIGS. 7A-7B, there is shown a first embodiment of a packet blank 170 that is configured to be folded to form a packet (e.g., packets 130, 140; for convenience, the packet blank of FIGS. 7A-7B is referred to below as forming the packet 140). Other suitable blank designs, and manners and methods for assembling those blanks, are set forth in U.S. Pat. App. Pub. Nos. 2005/0023158 to Mitten et al. and 2005/0150786 to Mitten et al. As such, the blank can be adapted to resemble and operate in many regards like a hard package or crush proof box traditionally used in the cigarette packaging industry. For the embodiment shown, the first packet blank 170 includes a body portion having flaps for folding assembly and—as shown in FIG. 7B—an upper insert portion 172 that can be adhered thereto to form the upper frame insert structure discussed with reference to FIG. 2 and the second packet 140. In preferred embodiments, the region of the outer surface of the packet formed by the blank 170 and visible when it is extended from the outer sleeve 110 is printed with brand logos, brand-related colors and graphics, UPC bar code graphics, excise tax related information, regulatory content, or the like. In a lower region of the rear wall 140*d* of the packet is the cut-out region 142, and the catch-tab 144. Inward bias of the catch-tab 144 may be facilitated by a creased line, a pre-stressed fold line, a score line, a line of perforations, or a line of cuts in the region or along the line that delineates between the bottom packet wall 140*e* and the catch-tab 144. Such a blank can be assembled to provide a packet 140 suitable for containing ten filtered cigarettes (or a different number, as desired).

Figure 8:
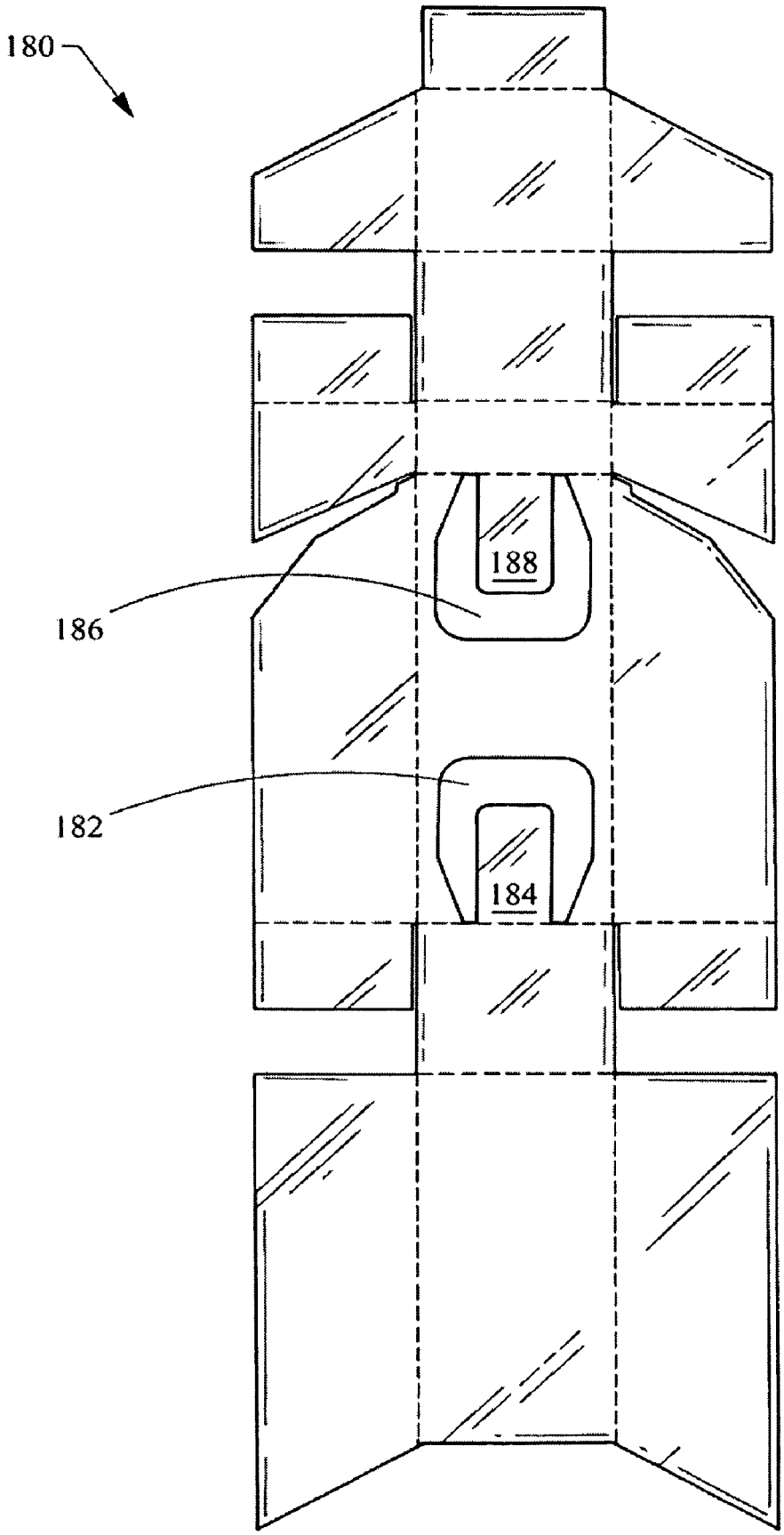
FIG. 8 is a diagrammatic illustration of a blank configured to form another packet embodiment.
Figure 8A:
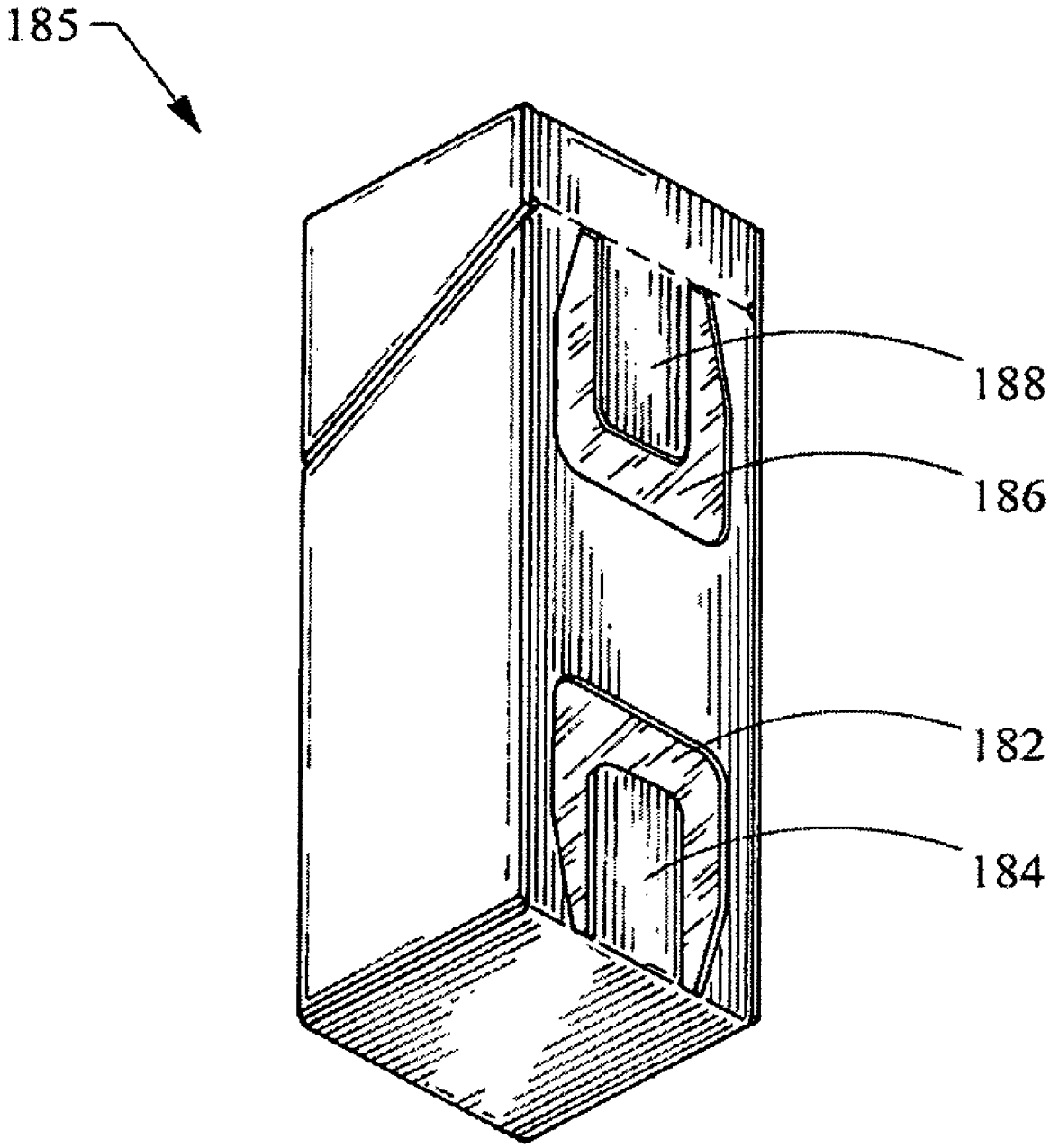
FIG. 8A depicts a rear perspective view of the blank of FIG. 8, assembled to form a packet.

Referring to FIGS. 8-8A, there is shown a second packet blank assembly 180 configured to be formed into a packet 185 and is generally similar in many regards to the blank described previously with reference to FIG. 7 and the packet described with reference to FIG. 3. The blank 180 includes a lower cut out region 182, and a first catch-tab 184. The blank 180 also includes an upper cut out region 186 with a second catch-tab 188. Inward bias of the catch-tabs may be facilitated by a creased line, a pre-stressed fold line, a score line, a line of perforations, or a line of cuts in the region or along the line that separates the rear wall from the catch-tabs. In this manner, the blank 180 is formed to provide a packet that includes two catch means: an upper catch means providing resistance to removal of packets through the top of an outer sleeve, and a lower catch means providing resistance to removal of packets through the bottom of an outer sleeve (such as, for example, the outer sleeves shown in FIGS. 6A-6B). The positioning of each catch-tab can be altered in order to provide for control of the extent to which the packets can be moved up and down within the outer sleeve. FIG. 8B shows a rear perspective view of the second packet blank as an assembled packet with two catch-tabs.

Figure 9A:
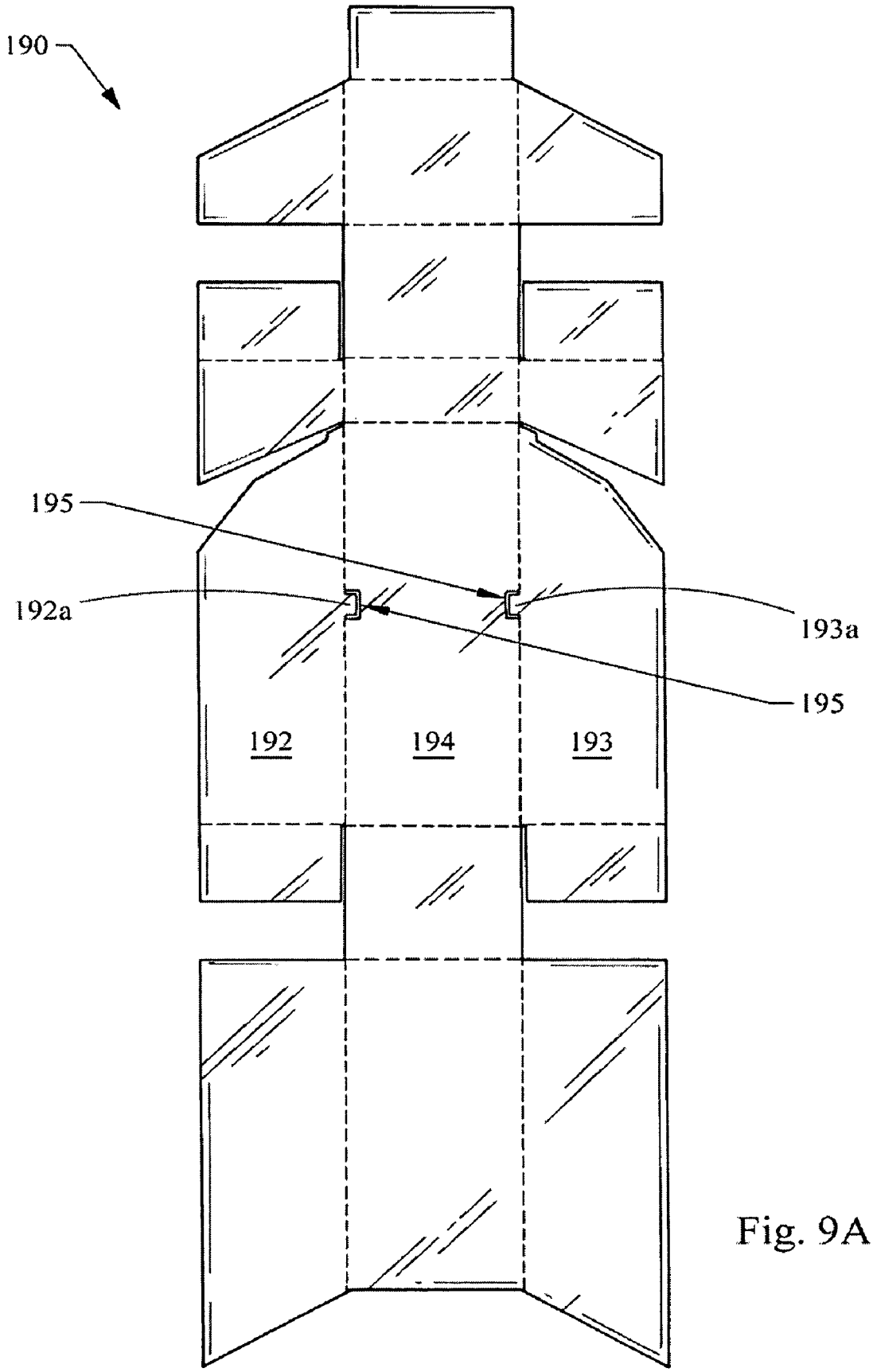
FIG. 9A is a diagrammatic illustration of a blank configured to form another packet embodiment.
Figure 9D:
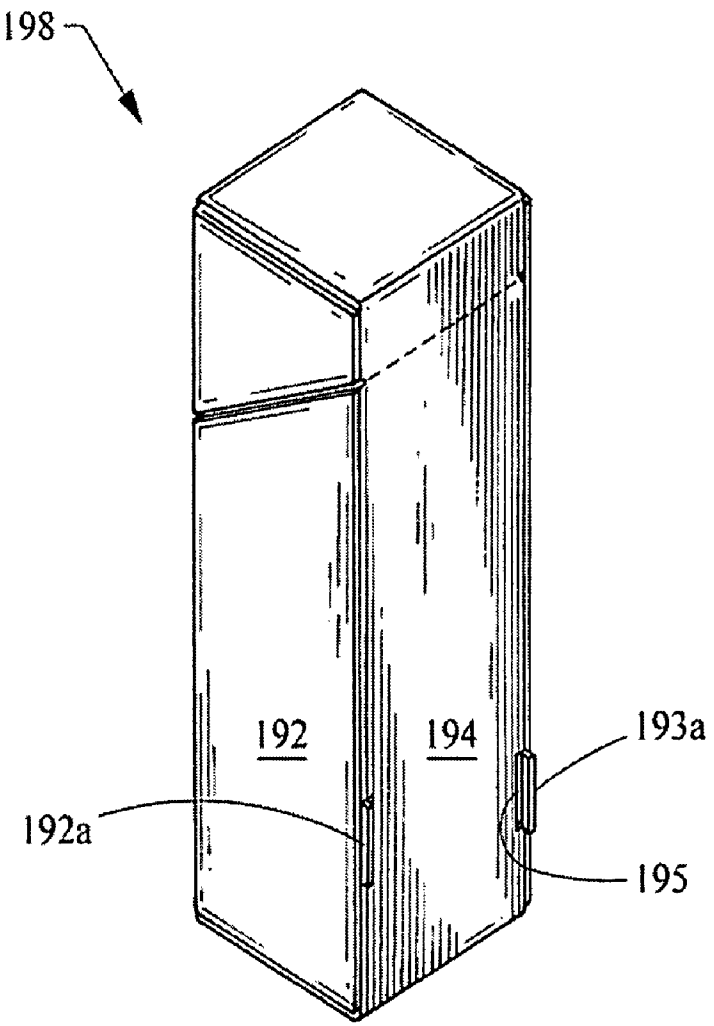
FIGS. 9C-9D depict an alternative embodiment of the packet of FIGS. 9A-9B, as a blank and assembled, respectively.
Figure 9B:
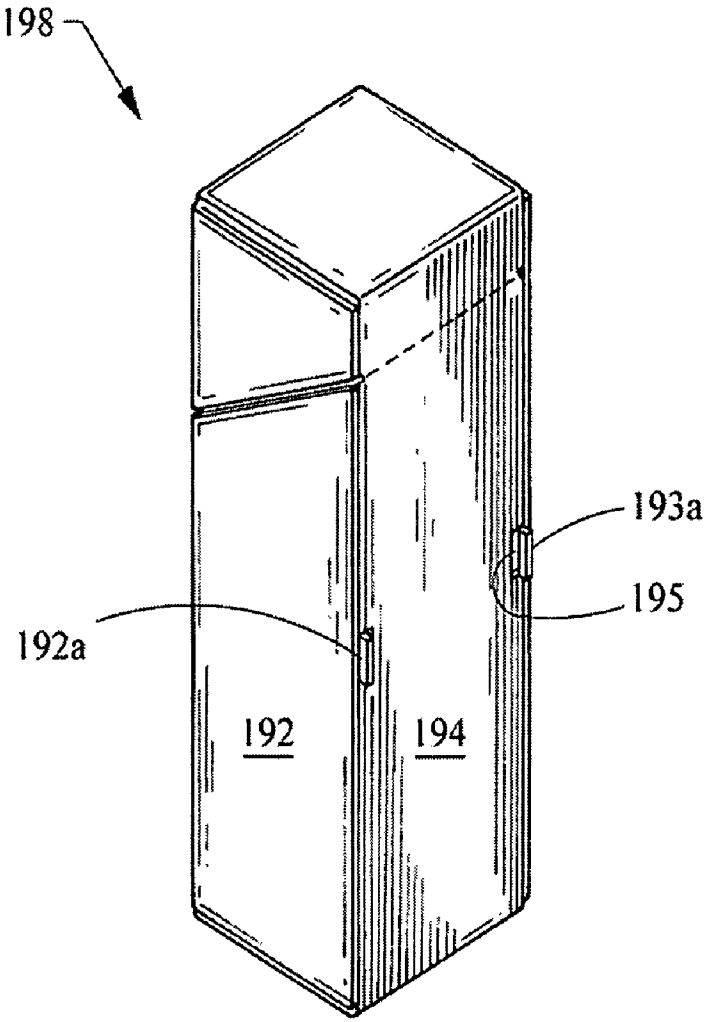
FIG. 9B depicts a rear perspective view of the blank of FIG. 9A, assembled to form a packet.
Figure 9C:
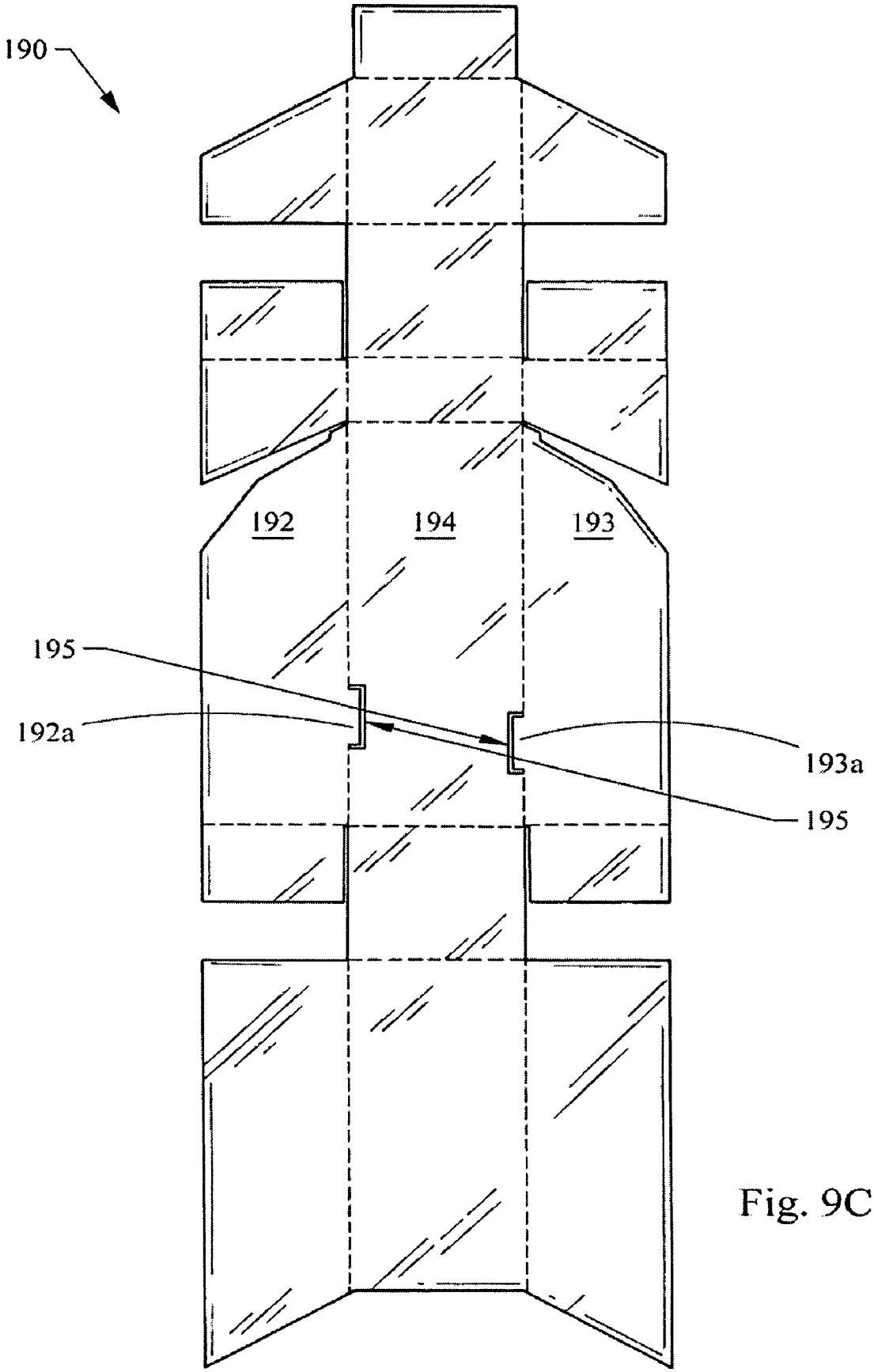

Referring to FIGS. 9A-9D, there is shown a third packet blank 190 that is configured to be folded into a packet 198. As shown, the third blank 190 does not include cut-out regions and catch-tabs of the type described previously with reference to FIGS. 7A-8B. Rather, the rear corners separating the side walls 192, 193 from the rear wall 194 each include a notch 195, thereby forming a pair of stop-tabs 192*a*, 193*a* that extend rearward of the rear wall 194 when the third packet 198 is formed, as is shown in FIG. 9A. These notches 195 are of a general type similar to, and can be provided using the types of techniques used to provide, the notches traditionally used for upper inner frame portions of crush proof cigarette packages. The notches 195 within the blank 190 provide a catch mechanism for the packet formed from that blank. FIGS. 9B and 9D illustrate that the stop-tabs can be located higher or lower on the packet to limit vertical motion within the outer sleeve. Alternatively, one or more other tabs may be provided above or below the illustrated stop-tabs. FIGS. 9C-9D also show that the stop-tabs may be vertically offset from each other. In another alternative embodiment (not shown), the tabs may be otherwise offset from each other, or may be formed in a face of the blank. The packet can be used in conjunction with an outer sleeve formed from the types of blanks described above with reference to FIGS. 5-6B, and the stop-tabs 192*a*, 193*a* preferably function similarly to the catch-tabs described above (i.e., by engaging a retention flap of an outer sleeve such as, for example, retention flap 120).

Figure 10:
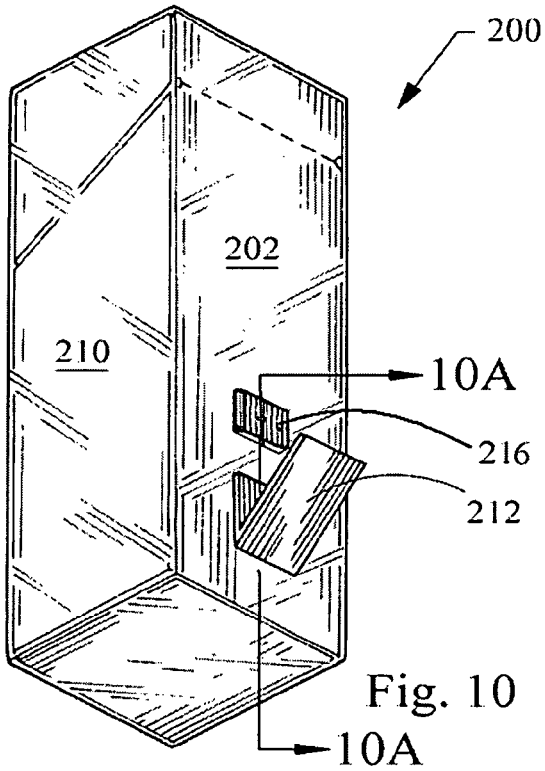
FIGS. 10-10A show, respectively, rear perspective and detail cross-sectional side views of a packet embodiment covered in a tab-equipped overwrap.
Figure 10A:
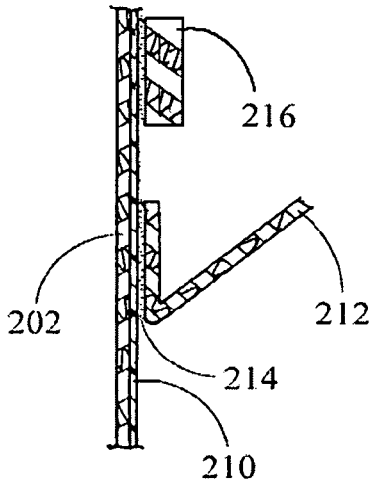

Referring to FIG. 10, there is shown a rear perspective view of a packet 200 lacking integrated retention/stop means. The packet 200 is provided with an optional overwrap film 210. An external stop-tab 212 is adhered to the outer surface of the overwrap film 210 across the rear wall 202 of the packet 200. In an alternative embodiment lacking overwrap, an external stop-tab may be adhered to the rear wall 202 itself. The external stop-tab 212 is formed from paperboard or a similarly stiff material and is folded downwardly and biased slightly away from the rear wall 202. FIG. 10A shows a side cross-section of the tab 212 mounted to the overwrap 210 by an adhesive 214. Alternatively, the external stop-tab can be provided from a strip of a different material (e.g., a flexible material that is comparable to tear tape commonly used for cigarette packaging, which may also be adhered to the inner surface of an outer sleeve). For example, and as shown in FIGS. 10-10A, an external stop-tab 216 may be provided from a strip of a different material. Preferably, the stop-tab 216 will be used independent of a stop-tab 212 and the embodiment shown is merely to illustrate both possible structures. Adhesion can be provided using the types of commercially available pressure sensitive adhesives (e.g., acrylate-type adhesives) commonly used for construction of plastic films during cigarette packaging assembly or any other suitable adhesive. As such, suitable tabs or catch mechanisms for limiting vertical movement in an outer sleeve may be provided using a separate tab piece that is adhered to an appropriate location on the packet or its overwrap, if present.

Figure 11:
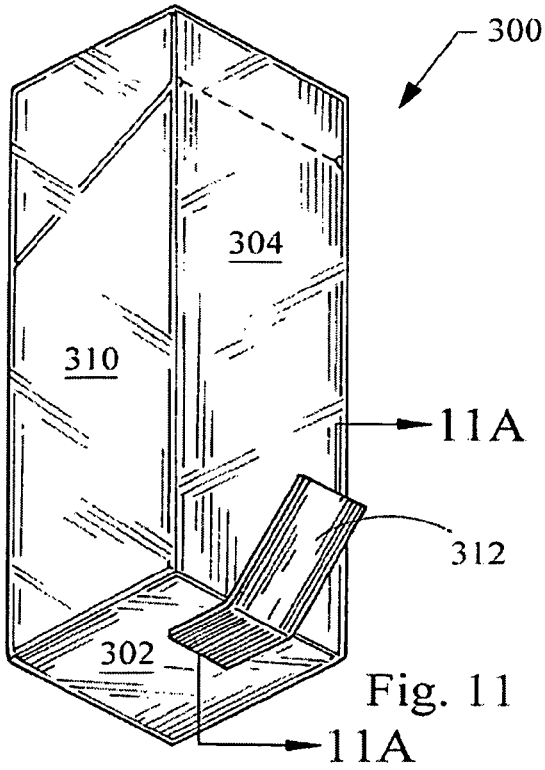
FIGS. 11-11A show, respectively, rear perspective and detail cross-sectional side views of another packet embodiment covered in a tab-equipped overwrap.
Figure 11A:
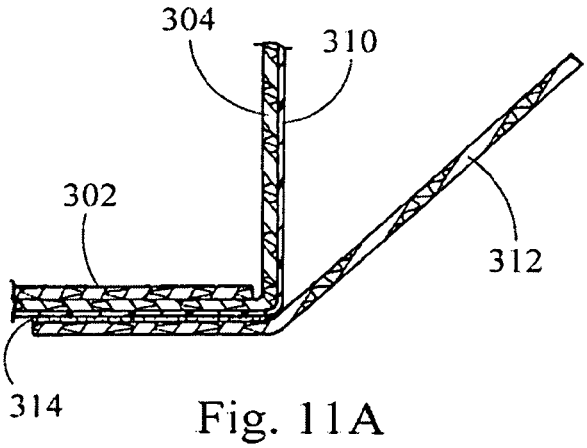

Referring to FIG. 11, there is shown a rear perspective view of a packet 300 lacking an integrated retention/stop means. The packet 300 is provided with an optional overwrap film 310. An external stop-tab 312 is adhered by an adhesive 314 to the outer surface of the overwrap film 310 on the bottom wall 302 of the packet 300 and extends upward adjacent the rear wall 304. In an alternative embodiment lacking overwrap, an external stop-tab may be adhered to the bottom wall 302 itself. The external stop-tab 312 is formed from paperboard or a similarly stiff material and is folded downwardly and biased slightly away from the rear wall 304. FIG. 11A shows a side cross-section of the tab 312 mounted to the overwrap 310.

For example, a flexible material that is comparable to tear tape commonly used for cigarette packaging, made of polyethylene, polystyrene, or the like, may be adhered to the outer surface of a relevant face of each inner packet (e.g., the strip of material can extend horizontally across at least a portion of the back face of that packet). Preferably, such strip is not bent or folded, but rather, is formed as a protrusion such as a ridge, or the like. For example, a strip may have a generally square or rectangular cross-sectional shape, and extend at least about 0.5 mm outwards from the relevant face of a packet. Adhesion can be provided using the types of commercially available pressure sensitive adhesives (e.g., acrylate-type adhesives) commonly used for construction of plastic films during cigarette packaging assembly or any other suitable adhesive. As such, suitable tabs or catch mechanisms for limiting vertical movement in an outer sleeve may be provided using a separate tab piece that is adhered to an appropriate location on the packet or its overwrap, if present.

Figure 13A:
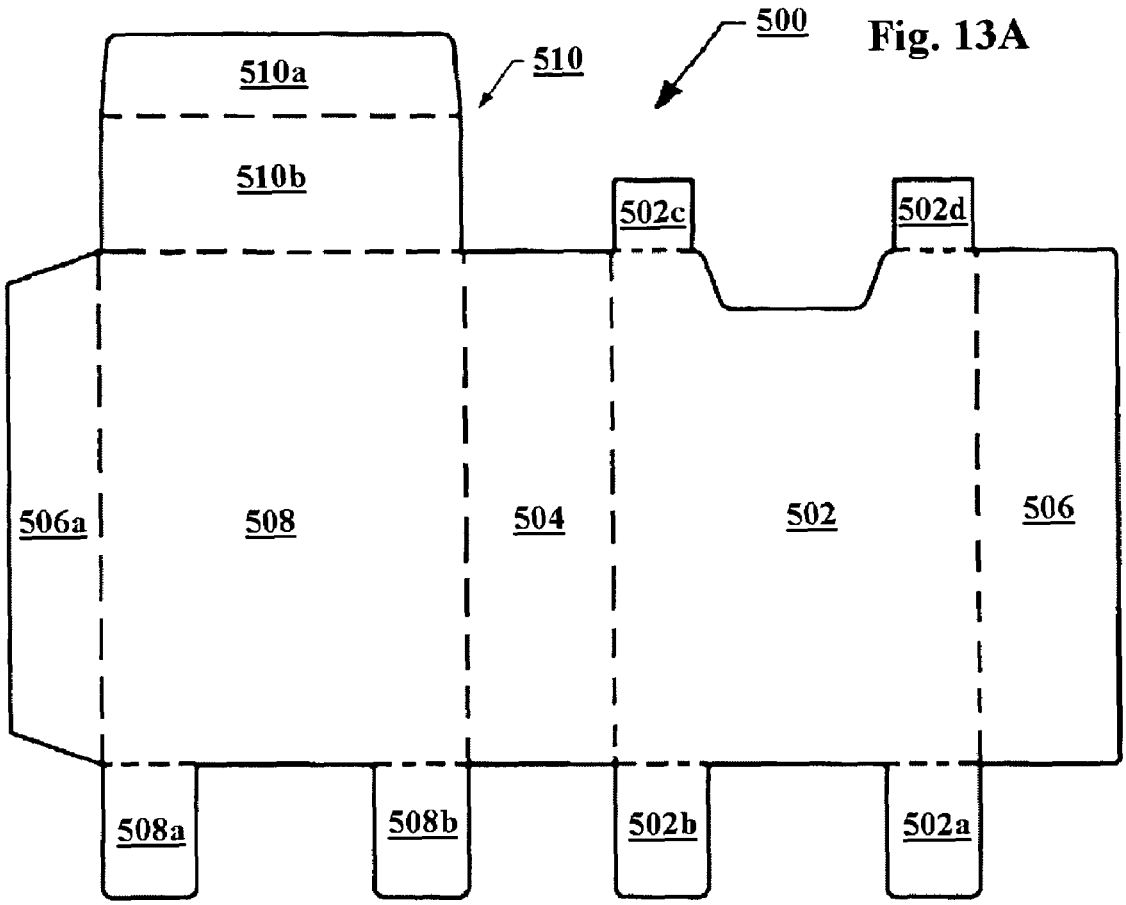
FIGS. 13A-13B show, respectively, a blank and an outer sleeve formed therefrom.
Figure 13B:
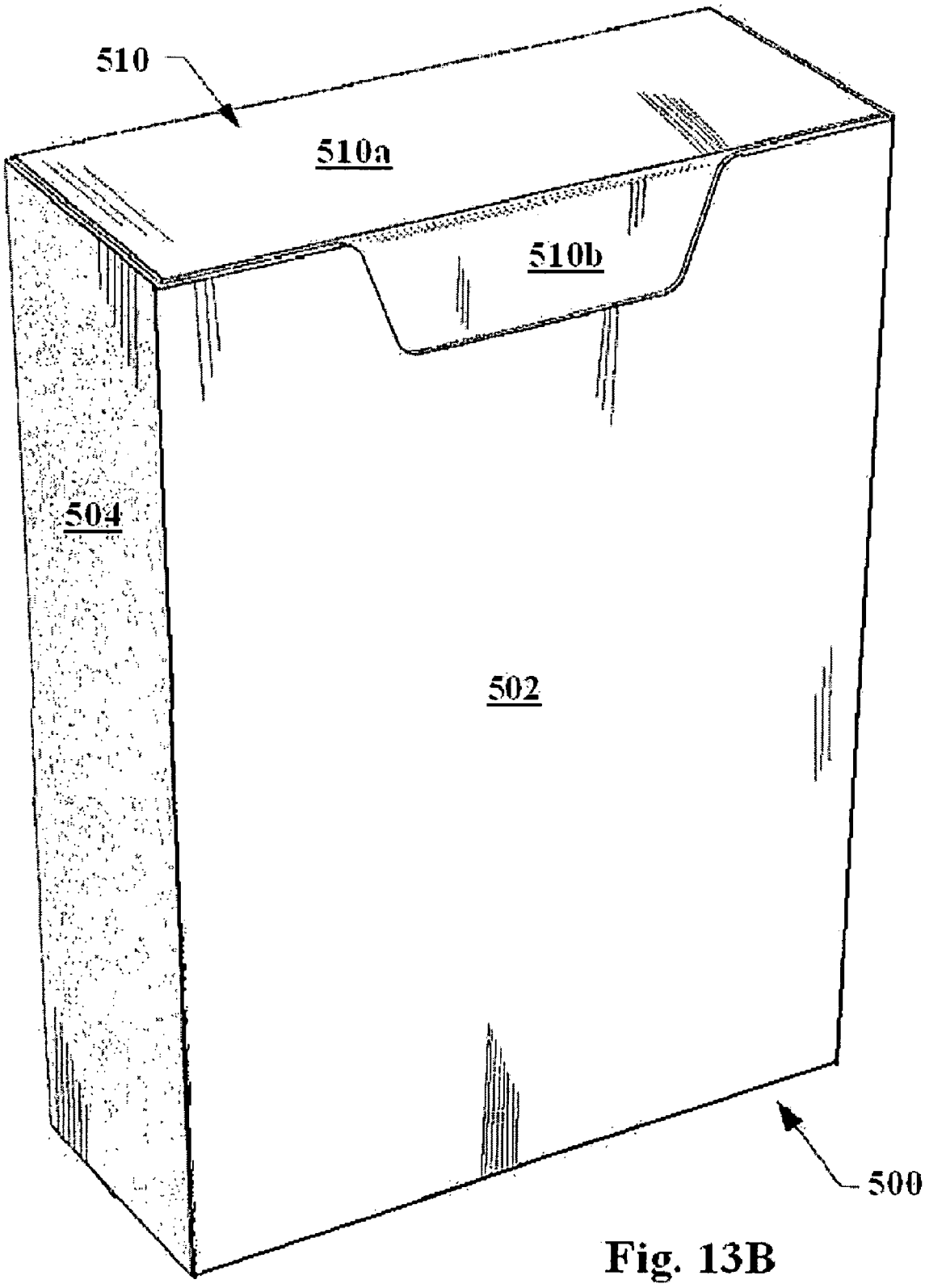
Figure 15:
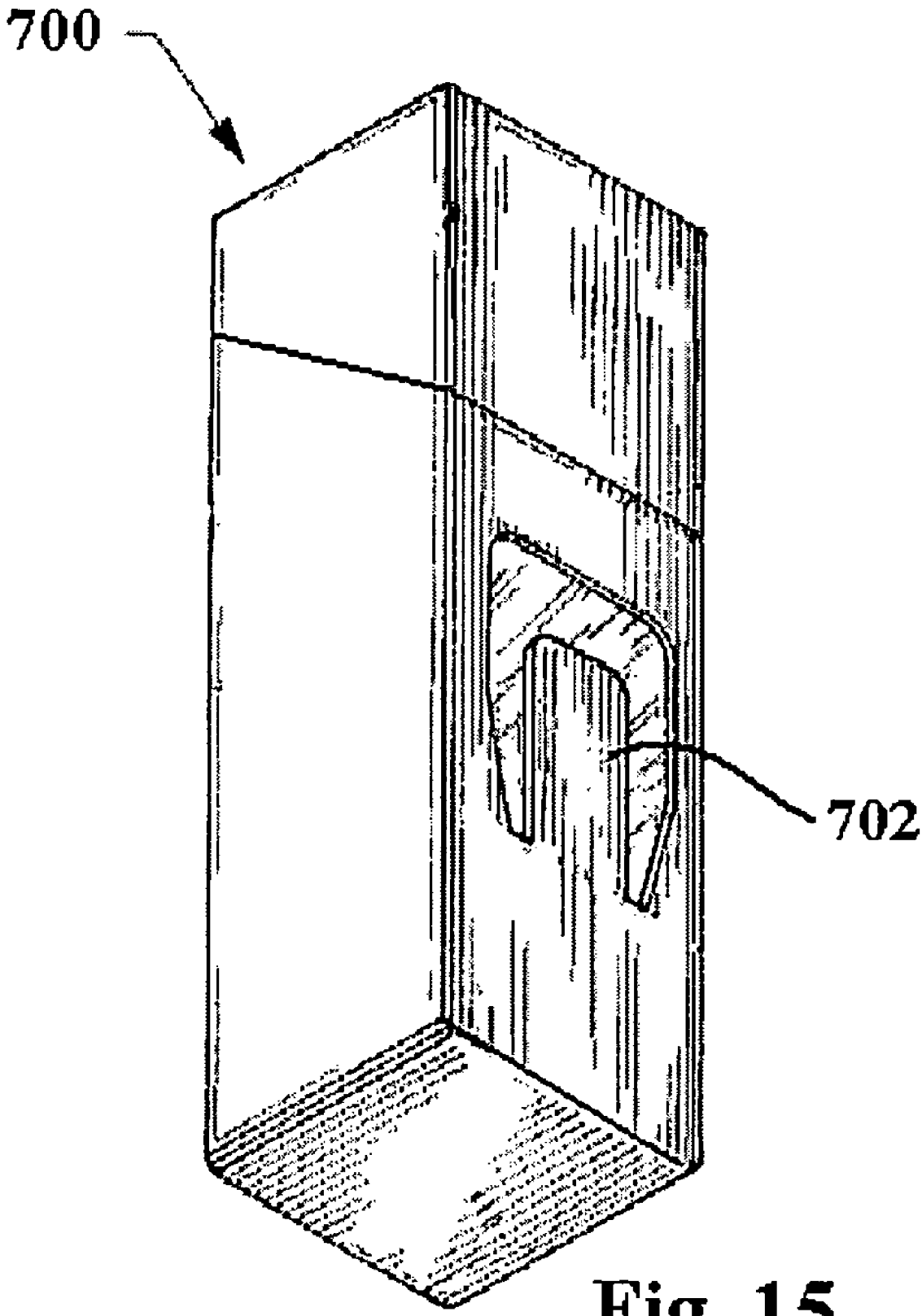
FIG. 15 shows another embodiment of a packet outside of an outer sleeve, and including a tab on its front wall.

In another container assembly embodiment, an outer sleeve may include a bottom wall that includes an open space for access to push up packets in the outer sleeve. For example, FIG. 13A shows a blank 500 configured to form an outer sleeve 500 (shown in FIG. 13B) that includes a front wall 502, left and right side walls 504, 506, and a rear wall 508. An optional lid portion 510 extends up from the rear wall 508 and includes a top lid panel 510*b* and a front lid panel 510*a*. The front lid panel 510*a* is configured to fold in behind the front wall 502, which optionally includes a cut-out portion to allow easier access to the front lid panel 510*a* for opening the lid 510. The outer sleeve 500 includes a partial bottom wall that includes a central opening 512. The partial bottom wall and opening 512 are formed by front flaps 502*a*, 502*b* extending from the front wall 502 and configured to be folded over and attached, respectively, to rear flaps 508*a*, 508*b*, which extend from the lower edge of the rear wall 508. The opening 512 is configured to allow a user to push up a packet in the outer sleeve for easier access to smoking articles therein. Optional retention flaps 502*c*, 502*d* extend from the upper edge of the front wall 502, and are configured to be folded down into the interior space of the outer sleeve 500 in the same manner as the retention flaps of above-described embodiments (e.g., being biased at least slightly away from the front wall 502). FIG. 15 shows a packet 700 that includes a front catch-tab 702, which is configured to engage a front retention flap (e.g., 502*c*, 502*d*) to prevent the packet 700 from being pushed out the top end of the outer sleeve 500. In another embodiment, the front catch-tab may be embodied as an adhered strip of material similar to the catch-tab 216 shown in FIGS. 10-10A. In all other aspects, a preferred packet 700 is like the packet described above with reference to FIGS. 3 and 7A. Those of skill in the art will appreciate that the retention flap(s) and corresponding catch-tab may be located elsewhere such as, for example, for use with a side wall of the outer sheath.

Figure 14A:
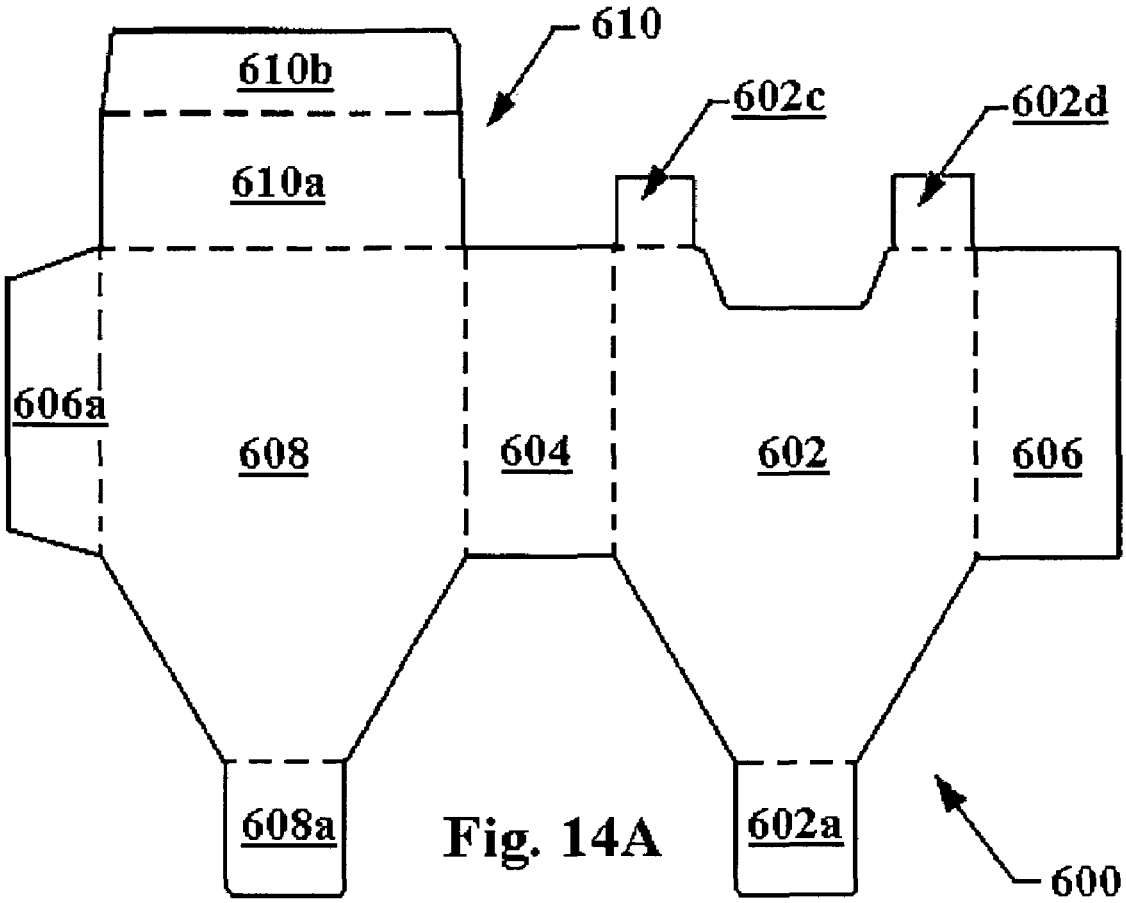
FIGS. 14A-14C show, respectively, a blank and two different top perspective views of an outer sleeve formed therefrom.
Figure 14B:
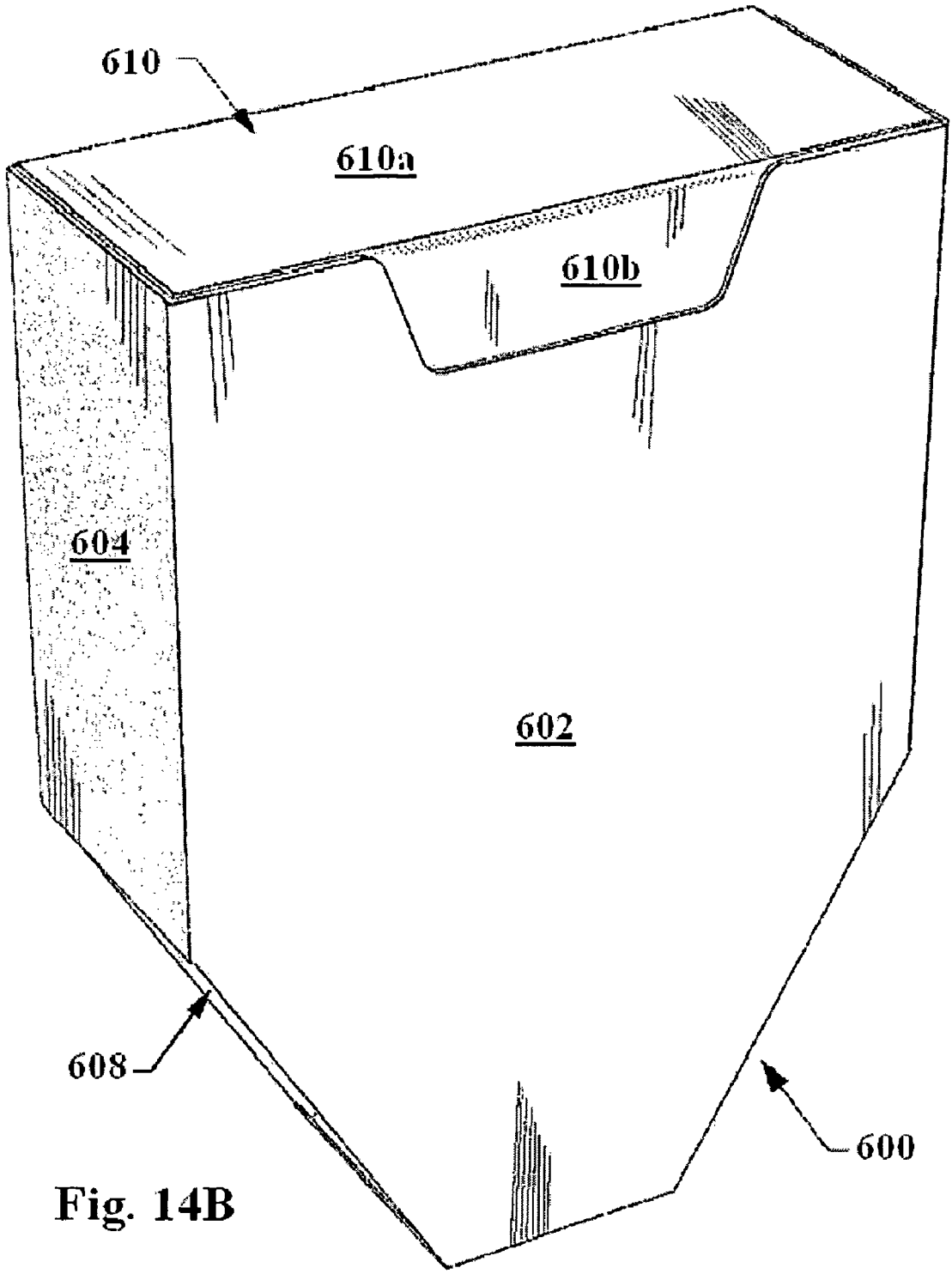
Figure 14C:
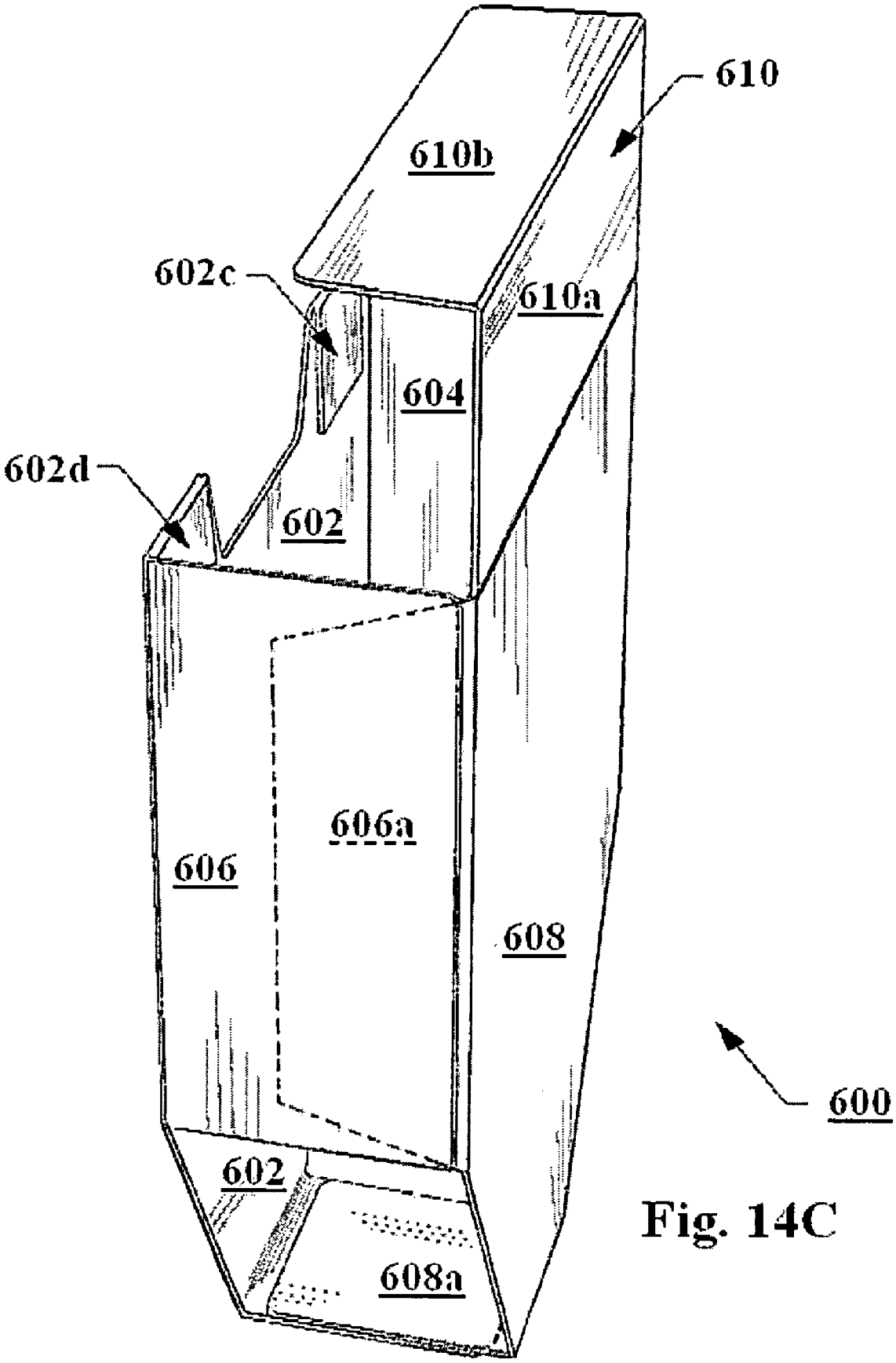

FIGS. 14A-14C illustrate another embodiment of an outer sleeve for use with a container assembly having a bottom wall that includes an open space for access to push up packets in the outer sleeve. FIG. 14A shows a blank 600 that is configured to be formed into an outer sleeve 600 as shown in FIGS. 14B-14C. The outer sleeve 600 includes a front wall 602, left and right side walls 604, 606, and a rear wall 608. An optional lid portion 610 extends up from the rear wall 608 and includes a top lid panel 610*b* and a front lid panel 610*a*. The front lid panel 610*a* is configured to fold in behind the front wall 602, which optionally includes a cut-out portion to allow easier access to the front lid panel 610*a* for opening the lid 610. The outer sleeve 600 includes a partial bottom wall and cut-out corner openings. The partial bottom wall and openings are formed by the cut shape of the blank 600 and rear flaps 608*a*, which extends from the rear wall 608 and folds over and to be attached to the front flap 602*a*, which extends from the lower edge of the front wall 602 (see FIG. 14C). The openings are configured to allow a user to push up each packet in the outer sleeve for easier access to smoking articles therein. Optional retention flaps 602*c*, 602*d* extend from the upper edge of the front wall 602, and are configured to be folded down into the interior space of the outer sleeve 600 in the same manner as the retention flaps of above-described embodiments. The packet 700 shown in FIG. 15 and described above is one example of a packet appropriate for use with the outer sleeve 600.

Components of the container assembly can be constructed from materials of the type traditionally used for cigarette packaging manufacture. For example, the various components of the container assembly can be constructed from resilient, durable paperboard-type material (e.g., low density solid bleached sulfate paperboard). Typically, the thickness of the paperboard-type material is in the range of about 0.010 inch to about 0.015 inch. Preferably, the thickness of paperboard-type material that is used to construct the outer sleeve portion is about 0.012 inch to about 0.014 inch. Most preferably, the thickness of paperboard-type material that is used to construct the packet portions of the container assembly is about 0.010 inch to about 0.012 inch.

Adhesive material used to assemble the various components of the container assembly can vary. Preferred adhesives include water-based polyvinylacetate-type adhesives. Adhesive materials useful for assembling paperboard cigarette packages, and manners and methods for applying those adhesives to paperboard-types of materials will be apparent to those skilled in the art of cigarette package design and assembly.

Overwrap materials can be used in association with the types of container assemblies set forth herein. Suitable overwrap materials include polypropylene films, such as films characterized as "cellophane-type films" that traditionally have been employed for wrapping packaged cigarettes. (See also the types of overwrap materials that are set forth in U.S. Pat. No. 4,807,745 to Langley et al.; U.S. Pat. No. 5,139,140 to Burrows et al.; U.S. Pat. No. 5,542,529 to Hein, III et al.; and U.S. Pat. No. 6,874,623 to Bray, each of which is incorporated herein by reference.) In certain preferred embodiments, the entire package assembly is wrapped with overwrap material.

The wrapping material of the assembly can be equipped with tear tape. See, for example, U.S. Pat. No. 4,717,017 to Sprinkel, Jr. et al.; U.S. Pat. No. 4,836,378 to Lephardt; U.S. Pat. No. 5,192,262 to Amendola et al.; U.S. Pat. No. 5,595,803 to May et al.; U.S. Pat. No. 6,363,691 to Flaherty; and U.S. Pat. No. 7,118,792 to Hewitt et al., each of which is incorporated herein by reference. Representative types of tear tape materials suitable for use in association with other cigarette packaging materials are available from sources such as Arlin Mfg. Co., Inc. and P. P. Payne Limited.

The maximum height of each container assembly can vary. The height of each container assembly typically is dependent upon factors such as the lengths of the cigarettes that are contained therein. Generally, the height is within the range of about 70 mm to about 130 mm. For example, for a container assembly designed to contain cigarettes, that are about 99 mm in length, a representative container assembly can have a height of about 100 mm to about 103 mm. Alternatively, for example, for a container assembly designed to contain cigarettes, each about 84 mm in length, a representative container assembly can have a height of about 85 mm to about 89 mm.

The width of each container assembly can also be varied depending upon the number and arrangement of cigarettes to be held. Typically, the width of a representative container assembly configured to hold twenty cigarettes is at least about 55 mm, and often is at least about 60 mm. Typically, the width of a representative container assembly does not exceed about 70 mm and often does not exceed about 65 mm.

Likewise, the depth of each container assembly may be varied. For a container configured to hold twenty cigarettes, the depth of a representative container assembly is at least about 20 mm and often is at least about 25 mm. Typically, the width of a representative container assembly does not exceed about 35 mm and often does not exceed about 30 mm. Preferably, the width and depth of the container assembly provide a convenient size for a user to carry (e.g., in a pocket or purse).

In a preferred embodiment, a representative assembled container has a height, width, depth, and overall shape that is comparable to that of cigarette packages that are traditionally employed to contain 20 cigarettes. As such, a preferred assembled container has overall dimensions that make it compatible with the dimensional requirements of applicable tax stamp machines and the associated carton recasing requirements. A representative assembled container has a maximum height of about 85 mm, a width of about 63 mm, a maximum depth of about 33 mm, and a minimum depth of about 26 mm. The outer sleeve preferably is constructed from paperboard having a thickness of about 0.012 inches (3.05 mm). The preferred container assembly includes two virtually identical packets, each packet independent of the other (i.e., each packet is not connected to the other, and each is configured to be moved/used independently of the other), and each packet containing ten filtered cigarettes. Each packet preferably is constructed from paperboard having a thickness of about 0.012 inches. In a preferred application using a package of the present invention for containing cigarettes, each cigarette is about 84 mm in length and about 24.5 mm in circumference. The packets are each generally rectangular in cross-sectional shape. Each packet is about 31 mm in width, about 25 mm in depth, and about 85 mm in length. A cut-out region in the bottom rear wall of each packet extends upwards about 23 mm, and the upwardly extending tab within that cut-out region has a width of about 8 mm and a height of about 18 mm.

Although the embodiments have been described with reference to particular tab designs and configurations, alternative types of tab arrangements can be employed. For example, coordinating and cooperating tabs or other stopping/retaining means can be positioned in more than one wall (i.e., to more than simply the rear walls of each of the outer sleeves and the associated packets). That is, tabs also can be positioned in appropriate locations in the front walls of the outer sleeve and the packets; and/or on side walls of the outer sleeve and on the side wall of each packet that contacts the outer sleeve. Alternatively, tabs can be positioned in appropriate locations in either or both of the side walls and/or the front wall. Furthermore, the tabs that are located on the bottom regions of the packets can be located more towards the upper region of those packets, and/or the tab located in the upper region of the outer sleeve can be provided by a horizontally-extending slit cut into at least a portion of the width of the rear face of the outer sleeve. Suitable types of catch mechanisms that can be suitably adapted include those of the type set forth in U.S. Pat. No. 5,682,986 to Cobler. As yet another example, appropriately positioned and configured tabs located on the upper regions of the packet and the lower region of the outer sleeve can act to limit the ability of the packets to be removed or separated from the container assembly by pushing those packets out through the bottom of the outer sleeve.

Although the embodiments have been described with reference to an outer sleeve of a particular design and configuration, alternative types of outer sleeve designs and configurations can be employed. For example, the outer sleeve of the container assembly can include removable top and/or bottom portions. As another example, the outer sleeve can have an integrally connected movable top, such as the type of top characteristic of crush proof boxes or hard packs traditionally used for the packaging of filtered cigarettes. As another example, the outer sleeve can include a bottom wall that partially covers the bottom region of the container assembly, and at least one opening in the bottom of the outer sleeve can allow for the ability to upwardly push the packets within the outer sleeve.

Although the preferred outer sleeve and associated components are constructed from paperboard-types of materials, the outer sleeve and certain other associated components can be constructed from a variety of other materials. For example, those components can be constructed from composite materials, laminated materials, or the like. Alternatively, those components can be molded from plastic materials, fashioned from metal, or the like.

In one aspect, the present container system provides for discrete packaging together of two cigarette types. For example, in a container with two packets, a first packet may contain a first cigarette flavor (e.g., fruit, natural, menthol) while the second packet contains another cigarette flavor. Likewise, different cigarette qualities may be packaged side by side (e.g., tobacco density, variety, etc.). In such embodiments, it is most preferable that each individual packet be individually overwrapped with a suitable material.

It is therefore intended that the foregoing detailed description be regarded as illustrative rather than limiting, and it should be understood that the following claims, including all equivalents, are intended to define the spirit and scope of this invention.

We claim:

1. A container for smoking articles, the container comprising:

a generally rectilinear outer sleeve member having front, left side, right side, and rear walls forming a cavity open at least at a first cavity end;

at least two generally rectilinear packet members constructed of paperboard-type material, each configured for substantially fully enclosing smoking articles, and slidably disposed and adjacent each other at least partially within the cavity; and a catch mechanism configured to prevent the at least two packets from being fully removed from the outer sleeve cavity wherein the catch mechanism comprises:

a first retention flap that is continuous with a wall of the outer sleeve member, said first flap being biased at least slightly into the outer sleeve cavity; and a first tab that is continuous with and extending at least slightly outwardly from a surface of a first one of the at least two packet members;

wherein the first tab is configured to engage the first retention flap when the first packet member is moved in a first direction relative to the outer sleeve, and wherein the engagement prevents movement in the first direction beyond a first pre-determined position.

2. The container of claim 1, wherein the first pre-determined position is set such that the first packet member extends out of the first cavity end of the outer sleeve by less than the full length of the first packet member.

3. The container of claim 1, the catch mechanism further comprising:

a second retention flap that is continuous with a wall of the outer sleeve member, said second flap being biased at least slightly into the outer sleeve cavity; and a second tab that is continuous with and biased slightly outwardly from a surface of a first one of the at least two packet members;

wherein the second tab is configured to engage the second retention flap when the first packet member is moved in a second direction relative to the outer sleeve, and wherein the engagement prevents movement in the second direction beyond a second pre-determined position.

4. The container of claim 3, wherein the second pre-determined position is set such that the first packet member extends out of a second end of the outer sleeve cavity by less than the full length of the first packet member.

5. The container of claim 1, wherein a first of the at least two packet members comprises a front wall, a bottom wall, left and right side walls, a rear wall, and an openable lid portion.

6. The container of claim 5, wherein the first tab is substantially co-planar with at least one of the front wall, bottom wall, left side wall, right side wall, or rear wall.

7. The container of claim 1, further comprising a wrapping material substantially covering a first of the at least two packets.

8. The container of claim 7, wherein the wrapping material comprises a generally transparent material.

9. The container of claim 7, wherein the catch mechanism further comprises:

a first sleeve tab that is attached to and extending at least slightly outwardly from a surface of the wrapping material;

wherein the first sleeve tab is configured to engage the first retention flap when the first packet member is moved in a first direction relative to the outer sleeve, and wherein the engagement prevents movement in the first direction beyond a first pre-determined position.

10. The container of claim 1, further comprising a wrapping material substantially enclosing the container.

11. The container of claim 1, further comprising a plurality of cigarettes wherein a first of the at least two generally rectilinear packet members contains a first sub-plurality of the plurality of cigarettes that differ in at least one property from a second sub-plurality of the plurality of cigarettes contained in a second of the at least two generally rectilinear packet members.

12. A smoking article container system, the system comprising:

a container comprising a generally rectilinear outer sleeve member having front, left side, right side, and rear walls forming a cavity open at least at a first cavity end;

at least two generally rectilinear packet members constructed of paperboard-type material, said packet members slidably disposed and adjacent each other at least partially within the cavity; and a catch mechanism configured to prevent the at least two packet members from being fully removed from the outer sleeve cavity;

a plurality of smoking articles substantially fully enclosed within each of the at least two generally rectilinear packet members; and a wrapping material substantially covering a first of the at least two packet members;

wherein the catch mechanism comprises:

a first sleeve tab that is attached to and extending at least slightly outwardly from a surface of the wrapping material; and a first retention flap that is continuous with a wall of the outer sleeve member, said first flap being biased at least slightly into the outer sleeve cavity wherein the first sleeve tab is configured to engage the first retention flap when the first packet member is moved in a first direction relative to the outer sleeve, and wherein the engagement prevents movement in the first direction beyond a first pre-determined position.

13. The smoking article container system of claim 12, wherein the plurality of smoking articles substantially fully enclosed within a first of the at least two generally rectilinear packet members differ in at least one property from the plurality of smoking articles contained within a second of the at least two generally rectilinear packet members.

14. The smoking article container system of claim 12, wherein the first pre-determined position is set such that the first packet member extends out of the first cavity end of the outer sleeve by less than the full length of the first packet member.

15. The smoking article container system of claim 14, wherein the catch mechanism further comprises:

a second retention flap that is continuous with a wall of the outer sleeve member, said second flap being biased at least slightly into the outer sleeve cavity; and a second tab that is continuous with and biased slightly outwardly from a surface of a first one of the at least two packet members;

wherein the second tab is configured to engage the second retention flap when the first packet member is moved in a second direction relative to the outer sleeve, and wherein the engagement prevents movement in the second direction beyond a second pre-determined position.

16. A container for smoking articles comprising:

an outer sleeve defining an open cavity and having four side walls, with an abutment extending from at least one side wall into the open cavity;

at least two packet members constructed of paperboard-type material and configured for containing smoking articles and slidably contained within the outer sleeve; the at least two packet members each comprising a tab that engages the abutment to stop a sliding movement of each packet member at a predetermined position when that packet member is slid toward a substantially open end of the outer sleeve;

wherein for a first of the at least two packet members, the tab is disposed on a first side wall of the first packet member and is defined by a cut-out region of the first side wall around three sides of the tab.

17. The container of claim 16, wherein the tab extends at least slightly out of a plane defined by the first side wall of the first packet member.

18. The container of claim 16, wherein the tab is generally coplanar with a plane defined by the second side wall of the first packet member that is substantially perpendicular to the first side wall of the first packet member.

19. The container claim 16, further comprising a plurality of smoking articles contained in each of the at least two packet members, wherein the plurality of smoking articles contained within a first of the at least two packet members differ in at least one property from the plurality of smoking articles contained within a second of the at least two packet members.

20. The container of claim 19, further comprising a wrapping material substantially enclosing at least one of the at least two packet members.

21. The container of claim 16, further comprising a wrapping material substantially enclosing the container.

22. The container of claim 1, further comprising a plurality of smoking articles disposed within each of the at least two packet members.

23. The container of claim 1, wherein the first tab is defined on all but one side by an opening in said surface, the opening having a greater surface area than the first tab.

24. The container of claim 16, wherein the first tab is defined on all but one side by an opening in said surface, the opening having a greater surface area than the first tab.

* * * * *